US011449002B2

(12) United States Patent
Saito et al.

(10) Patent No.: US 11,449,002 B2
(45) Date of Patent: Sep. 20, 2022

(54) IMAGE FORMING APPARATUS

(71) Applicants: Kei Saito, Tokyo (JP); Tomoya Adachi, Kanagawa (JP); Yuusuke Furuichi, Kanagawa (JP)

(72) Inventors: Kei Saito, Tokyo (JP); Tomoya Adachi, Kanagawa (JP); Yuusuke Furuichi, Kanagawa (JP)

(73) Assignee: RICOH COMPANY, LTD., Tokyo (JP)

( * ) Notice: Subject to any disclaimer, the term of this patent is extended or adjusted under 35 U.S.C. 154(b) by 0 days.

(21) Appl. No.: 17/480,154

(22) Filed: Sep. 21, 2021

(65) Prior Publication Data

US 2022/0091558 A1 Mar. 24, 2022

(30) Foreign Application Priority Data

Sep. 23, 2020 (JP) ..... JP2020-158606

(51) Int. Cl.
*G03G 21/20* (2006.01)

(52) U.S. Cl.
CPC ..... *G03G 21/206* (2013.01)

(58) Field of Classification Search
CPC ..... G03G 21/206
See application file for complete search history.

(56) References Cited

U.S. PATENT DOCUMENTS

2012/0045235 A1* 2/2012 Shiori ..... G03G 15/553 399/53
2013/0058676 A1* 3/2013 Sato ..... G03G 21/1803 399/92
2016/0195846 A1* 7/2016 Koshizuka ..... G03G 21/20 399/94
2016/0209806 A1* 7/2016 Shiomi ..... G03G 21/206
2018/0136586 A1* 5/2018 Tsuchiya ..... G03G 15/0881
2019/0278199 A1* 9/2019 Koga ..... G03G 15/0898
2019/0286013 A1 9/2019 Saito et al.
2019/0317424 A1* 10/2019 Koga ..... G03G 15/0813
2020/0183307 A1 6/2020 Furuichi et al.
(Continued)

FOREIGN PATENT DOCUMENTS

JP 2007-279263 10/2007
JP 2013-254018 12/2013
JP 2016-062024 4/2016

*Primary Examiner* — Sevan A Aydin
(74) *Attorney, Agent, or Firm* — Xsensus LLP

(57) ABSTRACT

An image forming apparatus includes a heating device including a heater, a developing device, and an airflow generation device. The heater includes a base, a heat generator, an electrode portion, and conductive portions. The conductive portions are disposed on one side and another side in a longitudinal direction in a heat generation region and spaced apart in a lateral direction intersecting the longitudinal direction. A maximum total value among total values of squares of current flowing in the conductive portions at longitudinal positions on the one side is larger than that on said another side. The developing device includes a rotating member and sliding portions. A sliding portion having highest temperature in operation is disposed on one side of the developing device being same as the one side of the heater in the longitudinal direction. The airflow generation device generates an airflow toward the one side of the developing device.

17 Claims, 17 Drawing Sheets

(56) References Cited

U.S. PATENT DOCUMENTS

| | | | |
|---|---|---|---|
| 2020/0249601 | A1 | 8/2020 | Inoue et al. |
| 2020/0249602 | A1 | 8/2020 | Inoue et al. |
| 2020/0249604 | A1 | 8/2020 | Adachi et al. |
| 2020/0292972 | A1 | 9/2020 | Inoue et al. |
| 2020/0292973 | A1 | 9/2020 | Furuichi et al. |
| 2020/0379384 | A1 | 12/2020 | Samei et al. |
| 2020/0387096 | A1 | 12/2020 | Adachi et al. |
| 2020/0401067 | A1 | 12/2020 | Samei et al. |
| 2021/0041810 | A1 | 2/2021 | Furuichi |
| 2021/0041832 | A1 | 2/2021 | Furuichi |
| 2021/0157259 | A1 | 5/2021 | Inoue et al. |
| 2021/0165344 | A1 | 6/2021 | Saito et al. |

* cited by examiner

| | FIRST BLOCK | SECOND BLOCK | THIRD BLOCK | FOURTH BLOCK | FIFTH BLOCK | SIXTH BLOCK | SEVENTH BLOCK |
|---|---|---|---|---|---|---|---|
| AMOUNT OF HEAT GENERATION IN FIRST POWER SUPPLY LINE 62A | 10000 | 6400 | 3600 | 1600 | 400 | — | — |
| AMOUNT OF HEAT GENERATION IN SECOND POWER SUPPLY LINE 62B | — | 400 | 1600 | 3600 | 6400 | 10000 | 14400 |
| AMOUNT OF HEAT GENERATION IN FOURTH POWER SUPPLY LINE 62D | 400 | 400 | 400 | 400 | 400 | 400 | — |
| TOTAL AMOUNT OF HEAT GENERATION | 10400 | 7200 | 5600 | 5600 | 7200 | 10400 | 14400 |

| | FIRST BLOCK | SECOND BLOCK | THIRD BLOCK | FOURTH BLOCK | FIFTH BLOCK | SIXTH BLOCK | SEVENTH BLOCK |
|---|---|---|---|---|---|---|---|
| AMOUNT OF HEAT GENERATION IN FIRST POWER SUPPLY LINE 62A | | 6400 | 3600 | 1600 | 400 | — | |
| AMOUNT OF HEAT GENERATION IN SECOND POWER SUPPLY LINE 62B | | 25 | 225 | 1225 | 3025 | 5625 | |
| AMOUNT OF HEAT GENERATION IN FOURTH POWER SUPPLY LINE 62D | | 25 | 25 | 25 | 25 | 25 | |
| TOTAL AMOUNT OF HEAT GENERATION | | 6450 | 3850 | 2850 | 3450 | 5650 | |

| | ARBITRARY POSITION α2 ON OTHER END e2 SIDE | CENTER m | ARBITRARY POSITION α1 ON ONE END e1 SIDE |
|---|---|---|---|
| AMOUNT OF HEAT GENERATION IN FIRST POWER SUPPLY LINE 62A | 8100 | 2500 | 100 |
| AMOUNT OF HEAT GENERATION IN SECOND POWER SUPPLY LINE 62B | 8100 | 2500 | 100 |
| TOTAL AMOUNT OF HEAT GENERATION | 16200 | 5000 | 200 |

IMAGE FORMING APPARATUS

CROSS-REFERENCE TO RELATED APPLICATION

This patent application is based on and claims priority pursuant to 35 U.S.C. § 119(a) to Japanese Patent Application No. 2020-158606, filed on Sep. 23, 2020, in the Japan Patent Office, the entire disclosure of which is incorporated by reference herein.

BACKGROUND

Technical Field

The present disclosure relates to an image forming apparatus.

Discussion of the Background Art

In an image forming apparatus such as a printer, in order to restrain the temperature rise of various devices mounted inside, an airflow is generated in a main body of the image forming apparatus by an airflow generation device such as a blower fan to cool the various devices.

For example, an image forming apparatus is known in which an airflow path for cooling a developing device and an airflow path for cooling a heating device (fixing device) are separately provided.

SUMMARY

According to an embodiment of the present disclosure, there is provided an image forming apparatus that includes a heating device, a developing device, and an airflow generation device. The heating device includes a heater. The heater includes a base, a heat generator, an electrode portion, and a plurality of conductive portions connecting the heat generator and the electrode portion. The plurality of conductive portions are disposed on one side and another side of the heater. The one side is opposite to said another side with respect to a center in a longitudinal direction of the heater in a heat generation region of the heater. The plurality of conductive portions are spaced apart in a lateral direction intersecting the longitudinal direction along a surface of the heater on which the heat generator is disposed. A maximum total value among total values of squares of current flowing in the plurality of conductive portions at arbitrary longitudinal positions on the one side in the heat generation region is larger than a maximum total value among total values of squares of current flowing in the plurality of conductive portions at arbitrary longitudinal positions on said another side in the heat generation region. The developing device includes a rotating member and a plurality of sliding portions to slide relative to the rotating member. A sliding portion having a highest temperature in operation among the plurality of sliding portions is disposed on one side of the developing device that is same as the one side of the heater in the longitudinal direction of the heater. The airflow generation device generates an airflow toward the one side of the developing device.

According to another embodiment of the present disclosure, there is provided an image forming apparatus that includes a heating device, a developing device, and an airflow generation device. The heating device includes a heater. The heater includes a heat generation portion, a second electrode portion, a first conductive portion, a second conductive portion, and a third conductive portion. The heat generation portion has at least one heat generator. The first conductive portion connects the heat generation portion and the first electrode portion. The second conductive portion extends from the heat generation portion toward first end of the heater in a longitudinal direction of the heater and is connected to the second electrode portion. The third conductive portion branches from the second conductive portion and extends toward a second end of the heater opposite to the first end in the longitudinal direction. The third conductive portion is connected to the second conductive portion or the second electrode portion not via the first conductive portion. The developing device includes a rotating member and a plurality of sliding portions configured to slide relative to the rotating member. A sliding portion having a highest temperature in operation among the plurality of sliding portions is disposed on a same side in a longitudinal direction of the developing device as one side of the heater with respect to a center of the heater in the longitudinal direction. The one side of the heater has a higher temperature in operation than another side of the heater. Said another side of the heater is opposite to the one side of the heater with respect to the center in the longitudinal direction in a heat generation region of the heater. The airflow generation device generates an airflow toward the one side.

According to an embodiment of the present disclosure, there is provided an image forming apparatus that includes a heating device, a developing device, and an airflow generation device. The heating device includes a heater. The heater includes a first heat generation portion, a second heat generation portion, a first electrode portion, a second electrode portion, a third electrode portion, a first conductive portion, a second conductive portion, and a third conductive portion. The first heat generation portion includes at least one heat generator. The second heat generation portion includes at least one heat generator different from the heat generator included in the first heat generation portion. The first conductive portion connects the first heat generation portion and the first electrode portion. The second conductive portion extends from the first heat generation portion toward a first end of the heater in a longitudinal direction of the heater and is connected to the second electrode portion. The third conductive portion branches from the second conductive portion and extends toward a second end of the heater opposite to the first end in the longitudinal direction. The third conductive portion is connected to the second conductive portion or the second electrode portion via the second heat generation portion and the third electrode portion and not via the first conductive portion. The first heat generation portion generates heat when a potential difference is generated between the first electrode portion and the second electrode portion. The developing device includes a rotating member and a plurality of sliding portions configured to slide relative to the rotating member. A sliding portion having a highest temperature in operation among the plurality of sliding portions is disposed on a same side in a longitudinal direction of the developing device as a side on which the second end of the heater is disposed with respect to a center in a heat generation area of the heater in the longitudinal direction of the heater. The airflow generation device generates an airflow toward the side on which the second end of the heater is disposed with respect to the center in the longitudinal direction of the heater.

According to an embodiment of the present disclosure, there is provided an image forming apparatus that includes a heating device, a developing device, and an airflow generation device. The heating device including a heater.

The heater includes a first heat generation portion, a second heat generation portion, a first electrode portion, a second electrode portion, a third electrode portion, a first conductive portion, a second conductive portion, and a third conductive portion. The first heat generation portion includes at least one heat generator. The second heat generation portion includes at least one heat generator different from the heat generator included in the first heat generation portion. The first conductive portion connects the first heat generation portion and the first electrode portion. The second conductive portion extends from the first heat generation portion toward a first end of the heater in a longitudinal direction of the heater and is connected to the second electrode portion. The third conductive portion branches from the second conductive portion and extends to a second end of the heater opposite to the first end in the longitudinal direction. The third conductive portion is connected to the second conductive portion or the second electrode portion via the second heat generation portion and the third electrode portion and not via the first conductive portion. The first heat generation portion and the second heat generation portion generate heat when a potential difference is generated between the first electrode portion and the second electrode portion and a potential difference is generated between the second electrode portion and the third electrode portion. The developing device includes a rotating member and a plurality of sliding portions configured to slide relative to the rotating member. A sliding portion having a highest temperature in operation among the plurality of sliding portions is disposed on a same side in a longitudinal direction of the developing device as a side on which the first end of the heater is disposed with respect to a center in a heat generation area of the heater in the longitudinal direction of the heater. The airflow generation device generates an airflow toward the side on which the first end of the heater is disposed with respect to the center in the longitudinal direction of the heater.

According to an embodiment of the present disclosure, there is provided an image forming apparatus that includes a heating device, a developing device, and an airflow generation device. The heating device includes a heater. The heater includes a base, a heat generator, an electrode portion, and a conductive portion connecting the heat generator and the electrode portion. A portion having a highest temperature in operation in the developing device is disposed on a same side in a longitudinal direction of the developing device as one side of the heater with respect to a center of the heater in the longitudinal direction. The one side of the heater having a higher temperature in operation than another side of the heater. Said another side of the heater being opposite to the one side of the heater with respect to the center in the longitudinal direction in a heat generation region of the heater. The airflow generation device is configured to generate an airflow toward the one side.

According to an embodiment of the present disclosure, there is provided an image forming apparatus that includes a heating device, a developing device, and an airflow generation device. The heating device includes a heater. The heater includes a base, a heat generator, an electrode portion, and a conductive portion connecting the heat generator and the electrode portion. The developing device includes a rotating member and a plurality of sliding portions configured to slide relative to the rotating member. A sliding portion having a highest sliding speed in operation among the plurality of sliding portions is disposed on a same side as one side of the heater with respect to a center of the heater in a longitudinal direction of the heater. The one side of the heater has a higher temperature in operation than another side of the heater. Said another side of the heater is opposite to the one side of the heater with respect to the center in the longitudinal direction in a heat generation region of the heater. The airflow generation device is configured to generate an airflow toward the one side.

BRIEF DESCRIPTION OF THE DRAWINGS

The aforementioned and other aspects, features, and advantages of the present disclosure would be better understood by reference to the following detailed description when considered in connection with the accompanying drawings, wherein.

Figure 1:
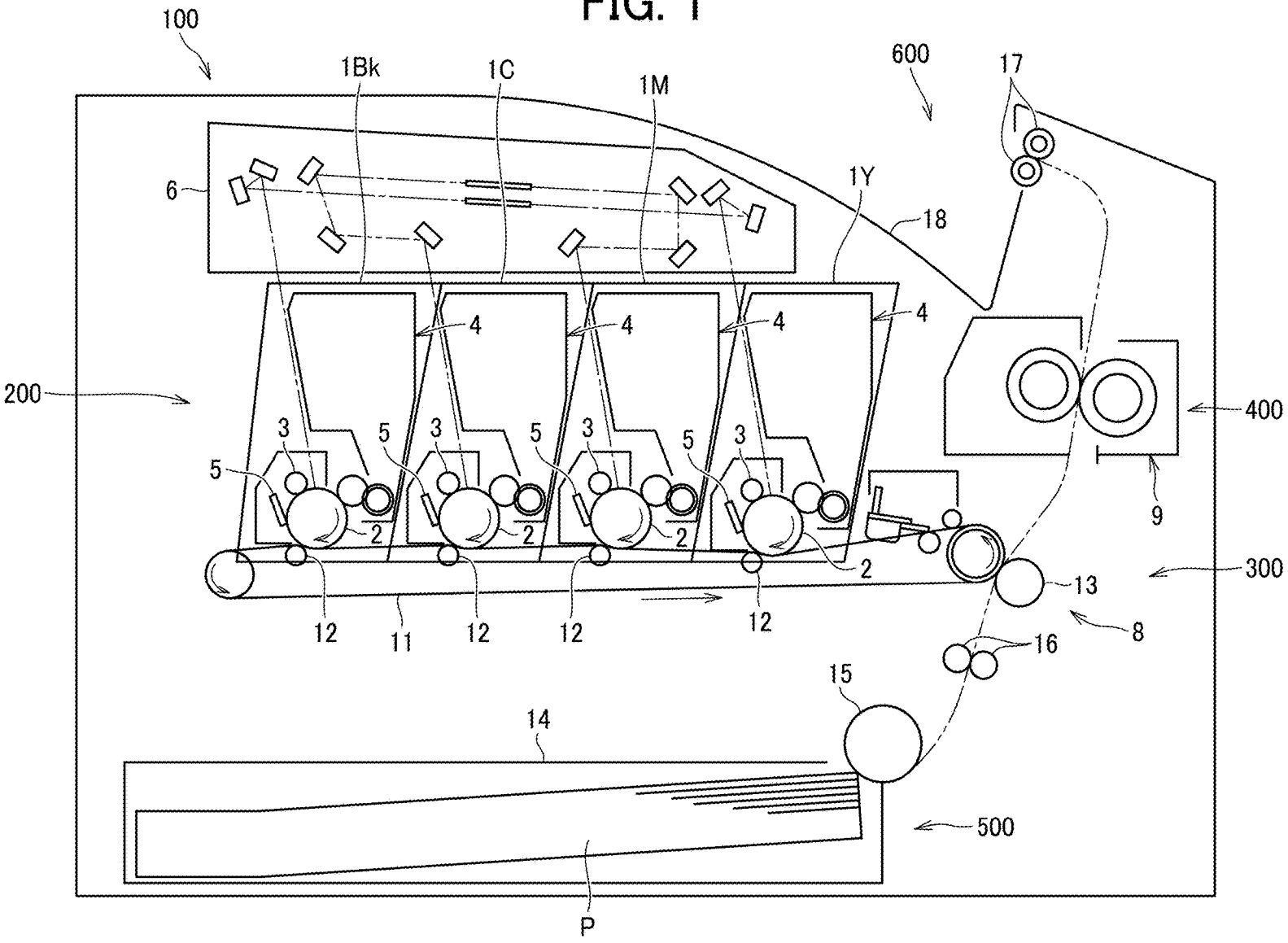
FIG. 1 is a schematic configuration diagram of an image forming apparatus according to an embodiment of the present disclosure.

The accompanying drawings are intended to depict embodiments of the present disclosure and should not be interpreted to limit the scope thereof. The accompanying drawings are not to be considered as drawn to scale unless explicitly noted.

DETAILED DESCRIPTION OF EMBODIMENTS

In describing embodiments illustrated in the drawings, specific terminology is employed for the sake of clarity. However, the disclosure of this patent specification is not intended to be limited to the specific terminology so selected and it is to be understood that each specific element includes all technical equivalents that operate in a similar manner and achieve similar results.

Although the embodiments are described with technical limitations with reference to the attached drawings, such description is not intended to limit the scope of the disclosure and all of the components or elements described in the embodiments of this disclosure are not necessarily indispensable.

Referring now to the drawings, embodiments of the present disclosure are described below. In the drawings for explaining the following embodiments, the same reference codes are allocated to elements (members or components) having the same function or shape and redundant descriptions thereof are omitted below.

Hereinafter, the present disclosure will be described with reference to the accompanying drawings. In the drawings for describing the present disclosure, constituent elements such as members and constituent parts having the same functions or shapes are denoted by the same reference numerals as far as discriminable, and the description thereof will be omitted.

FIG. 1 is a schematic configuration diagram of an image forming apparatus according to an embodiment of the present disclosure.

An image forming apparatus 100 illustrated in FIG. 1 includes an image forming unit 200, a transfer unit 300, a fixing unit 400, a recording medium supply unit 500, and a recording medium ejection unit 600.

The image forming unit 200 includes four image forming units 1Y, 1M, 1C, and 1Bk and an exposure device 6. The image forming units 1Y, 1M, 1C, and 1Bk are detachably attached to the main body of the image forming apparatus. The image forming units 1Y, 1M, 1C, and 1Bk basically are the same in configuration except that they contain toners (developers) of different colors of yellow, magenta, cyan, and black corresponding to color resolved components of a color image. Specifically, each of the image forming units 1Y, 1M, 1C, and 1Bk includes a photoconductor 2, a charging member 3, a developing device 4, and a cleaning member 5.

The transfer unit 300 includes a transfer device 8 that transfers an image onto a paper sheet that is a recording medium. The recording medium is not limited to paper such as plain paper, thick paper, thin paper, coated paper, label paper, or an envelope, and may be a resin sheet such as an overhead projector (OHP) sheet. The transfer device 8 includes an intermediate transfer belt 11, four primary transfer rollers 12, and a secondary transfer roller 13. The intermediate transfer belt 11 is an endless belt member stretched by a plurality of rollers. Each of the primary transfer rollers 12 is in contact with the photoconductor 2 via the intermediate transfer belt 11. As a result, a primary transfer nip in which the intermediate transfer belt 11 and each of the photoconductors 2 are in contact with each other is formed between the intermediate transfer belt 11 and each of the photoconductors 2. On the other hand, the secondary transfer roller 13 is in contact with one of the plurality of rollers stretching the intermediate transfer belt 11 with the intermediate transfer belt 11 in between. As a result, a secondary transfer nip is formed between the secondary transfer roller 13 and the intermediate transfer belt 11.

The fixing unit 400 includes a fixing device 9 that fixes an image on a paper sheet. A detailed configuration of the fixing device 9 will be described later.

The recording medium supply unit 500 includes a sheet feeding cassette 14 that accommodates paper sheets P and a sheet feeding roller 15 that feeds the paper sheets P from the sheet feeding cassette 14.

The recording medium ejection unit 600 includes a pair of sheet ejection rollers 17 that ejects paper sheets to the outside of the image forming apparatus, and a sheet ejection tray 18 on which the paper sheets ejected by the sheet ejection rollers 17 are placed.

Next, a printing operation of the image forming apparatus 100 according to the present embodiment will be described with reference to FIG. 1.

When the printing operation is started in the image forming apparatus 100, the photoconductors 2 of the image forming units 1Y, 1M, 1C, and 1Bk and the intermediate transfer belt 11 start to rotate. When the sheet feeding roller 15 starts to rotate, the sheet feeding roller 15 feeds the paper sheet P from the sheet feeding cassette 14. The fed paper sheet P comes into contact with a pair of timing rollers 16 and is temporarily stopped.

In the image forming units 1Y, 1M, 1C, and 1Bk, first, the charging members 3 charge the surfaces of the photoconductors 2 to a uniform high potential. Next, the exposure device 6 exposes the surfaces (charged surfaces) of the photoconductors 2 on the basis of image information of the document read by a document reading device or print image information instructed to print by a terminal. As a result, the potentials of the exposed portions decrease, and electrostatic latent images are formed on the surfaces of the photoconductors 2. Then, the developing device 4 supplies toner to the electrostatic latent images, and toner images are formed on the photoconductors 2. When the toner images formed on the photoconductors 2 reach the primary transfer nips (the positions of the primary transfer rollers 12) along with the rotation of the photoconductors 2, the toner images are transferred onto the rotating intermediate transfer belt 11 so as to sequentially overlap one another. Thus, a full-color toner image is formed on the intermediate transfer belt 11. Note that the image forming apparatus 100 can form a single color image using any one of the image forming units 1Y, 1M, 1C, and 1Bk, or can form an image of two or three colors using any two or three image forming units. After the toner image is transferred from the photoconductors 2 to the intermediate transfer belt 11, residual toner or foreign matters on the photoconductors 2 are removed by the cleaning members 5, and the photoconductors 2 prepare for formation of next electrostatic latent images.

The toner image transferred onto the intermediate transfer belt 11 is conveyed to the secondary transfer nip (the position of the secondary transfer roller 13) along with the rotation of the intermediate transfer belt 11, and is transferred onto the paper sheet P conveyed by the timing rollers 16. Then, the paper sheet P is conveyed to the fixing device 9, and the toner image is fixed on the paper sheet P by the fixing device 9. Thereafter, the paper sheet P is ejected to the sheet ejection tray 18 by the sheet ejection roller 17, and a series of printing operations ends.

Next, a configuration of the fixing device 9 according to the present embodiment will be described.

Figure 2:
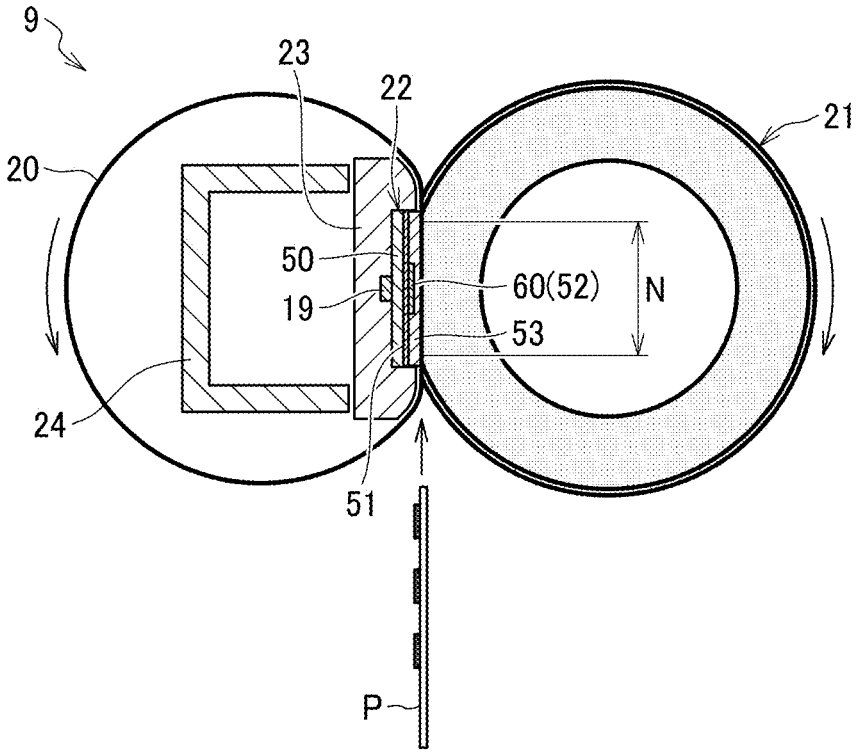
FIG. 2 is a schematic configuration diagram of a fixing device according to the present embodiment.

As illustrated in FIG. 2, the fixing device 9 according to the present embodiment includes a fixing belt 20, a pressure roller 21, a heater 22, a heater holder 23, a stay 24, and a temperature sensor 19.

The fixing belt 20 is an endless belt member, and comes into contact with the unfixed toner carrying surface of the paper sheet P to fix the toner image to the paper sheet P. The fixing belt 20 has a base made of polyimide. The material of the base is not limited to polyimide, and may be a heat-resistant resin such as polyetheretherketone (PEEK), or a metal material such as nickel or steel use stainless (SUS). In addition, in order to enhance durability and secure releasability, a release layer made of a fluororesin such as perfluoroalkoxy alkane (PFA) or polytetrafluoroethylene (PTFE) may be provided on the outer peripheral surface of the base. An elastic layer made of rubber or the like may be provided between the base and the release layer. Furthermore, a sliding layer made of polyimide, PTFE, or the like may be provided on the inner peripheral surface of the base.

The pressure roller 21 is an opposing rotating body disposed to face the outer peripheral surface of the fixing belt 20. The pressure roller 21 includes a metal cored bar, an elastic layer made of silicone rubber or the like provided on an outer peripheral surface of the cored bar, and a release layer made of fluororesin or the like provided on an outer peripheral surface of the elastic layer.

The fixing belt 20 and the pressure roller 21 are pressurized (pressed) against each other by a biasing member such as a spring, and a nip portion N is formed between the fixing belt 20 and the pressure roller 21. When the pressure roller 21 is rotationally driven by a drive source provided in the main body of the image forming apparatus, the driving force is transmitted to the fixing belt 20 at the nip portion N, whereby the fixing belt 20 is driven to rotate. Then, as illustrated in FIG. 2, when the paper sheet P carrying the unfixed image enters between the rotating fixing belt 20 and pressure roller 21 (nip portion N), the paper sheet P is heated and pressurized while being conveyed by the fixing belt 20 and the pressure roller 21. As a result, the unfixed image on the paper sheet P is fixed to the paper sheet P.

The heater 22 is a heating member that heats the fixing belt 20. In the present embodiment, the heater 22 includes a plate-like base 50, a first insulating layer 51 provided on the base 50, a conductor layer 52 provided on the first insulating layer 51, and a second insulating layer 53 covering the conductor layer 52. The conductor layer 52 includes a heat generation portion 60 that generates heat by energization.

The base 50 is formed of, for example, a metal material such as stainless steel (SUS), iron, or aluminum. The material of the base 50 is not limited to a metal material, and may be ceramic, glass, or the like. When the base 50 is formed of an insulating material such as ceramic, the first insulating layer 51 between the base 50 and the conductor layer 52 can be omitted. On the other hand, the metal material has excellent durability against rapid heating and is easy to process, and thus is suitable for reducing the cost of the heater. Among the metal materials, aluminum or copper is particularly preferable in that it has high thermal conductivity and hardly causes temperature unevenness. In addition, the base 50 can be manufactured from stainless steel at a lower cost than aluminum or copper.

The insulating layers 51 and 53 are formed of, for example, an insulating material such as heat-resistant glass. Specifically, ceramic, polyimide, or the like is used as the material of the insulating layers 51 and 53. In addition to the surface of the base 50 on which the first insulating layer 51 and the second insulating layer 53 are provided, an insulating layer may also be provided on the opposite surface of the base 50.

In the present embodiment, the heat generation portion 60 is disposed closer to the nip portion N than the base 50, but conversely, the base 50 may be disposed closer to the nip portion N than the heat generation portion 60. However, in that case, since the heat of the heat generation portion 60 is transmitted to the fixing belt 20 via the base 50, the base 50 is preferably formed of a material having high thermal conductivity such as aluminum nitride.

In the present embodiment, in order to increase efficiency of heat transfer from the heater 22 to the fixing belt 20, the heater 22 is disposed in direct contact with the inner peripheral surface of the fixing belt 20. However, the present disclosure is not limited thereto, and the heater 22 may be disposed in non-contact with the fixing belt 20 or in indirect contact with the fixing belt 20 with a low friction sheet or the like in between. The heater 22 may be in contact with the outer peripheral surface of the fixing belt 20. However, the heater 22 is preferably in contact with the inner peripheral surface of the fixing belt 20 in order to avoid the degradation of fixing quality that could be caused by scratches on the outer peripheral surface of the fixing belt 20.

The heater holder 23 is a heating member holding member that holds the heater 22 inside the fixing belt 20. Since the heater holder 23 is likely to have a high temperature due to the heat of the heater 22, the heater holder 23 is preferably formed of a heat-resistant material. In particular, when the heater holder 23 is formed of a heat-resistant resin having low thermal conductivity such as liquid crystal polymer (LCP) or PEEK, heat transfer from the heater 22 to the heater holder 23 is restrained while the heat resistance of the heater holder 23 is secured, so that the fixing belt 20 is efficiently heated.

The stay 24 is a reinforcing member disposed inside the fixing belt 20. Since the stay 24 supports the surface of the heater holder 23 opposite to the surface on the nip portion N side, the deflection of the heater holder 23 under the pressurizing force of the pressure roller 21 is restrained. As a result, the nip portion N having a uniform width is formed between the fixing belt 20 and the pressure roller 21. The stay 24 is preferably formed of an iron-based metal material such as SUS or steel electrolytic cold commercial (SECC) in order to secure its rigidity.

The temperature sensor 19 is a temperature detector that detects the temperature of the heater 22. A controller such as a microcomputer provided in the main body of the image forming apparatus controls the output of the heater 22 on the basis of the result of detection by the temperature sensor 19, whereby the temperature of the fixing belt 20 is controlled to be a desired temperature (fixing temperature). The temperature sensor 19 may be either a contact type or a non-contact type. As the temperature sensor 19, a known temperature sensor such as a thermopile, a thermostat, a thermistor, or an NC sensor can be applied.

Figure 3:
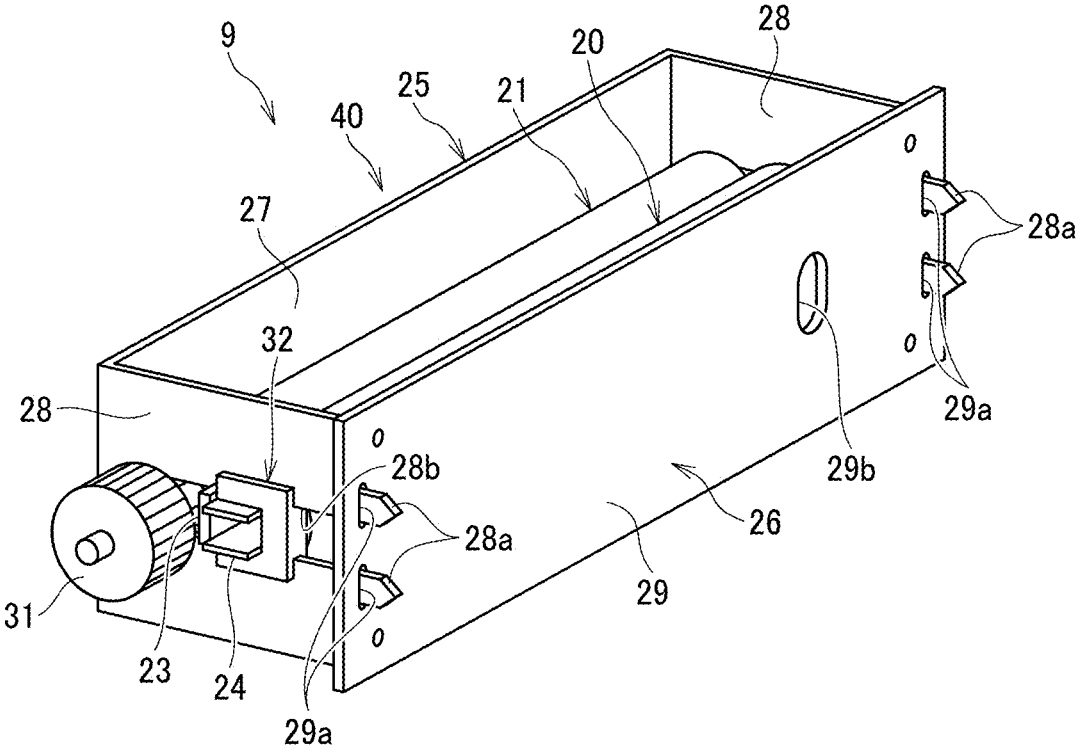
FIG. 3 is a perspective view of the fixing device.
Figure 4:
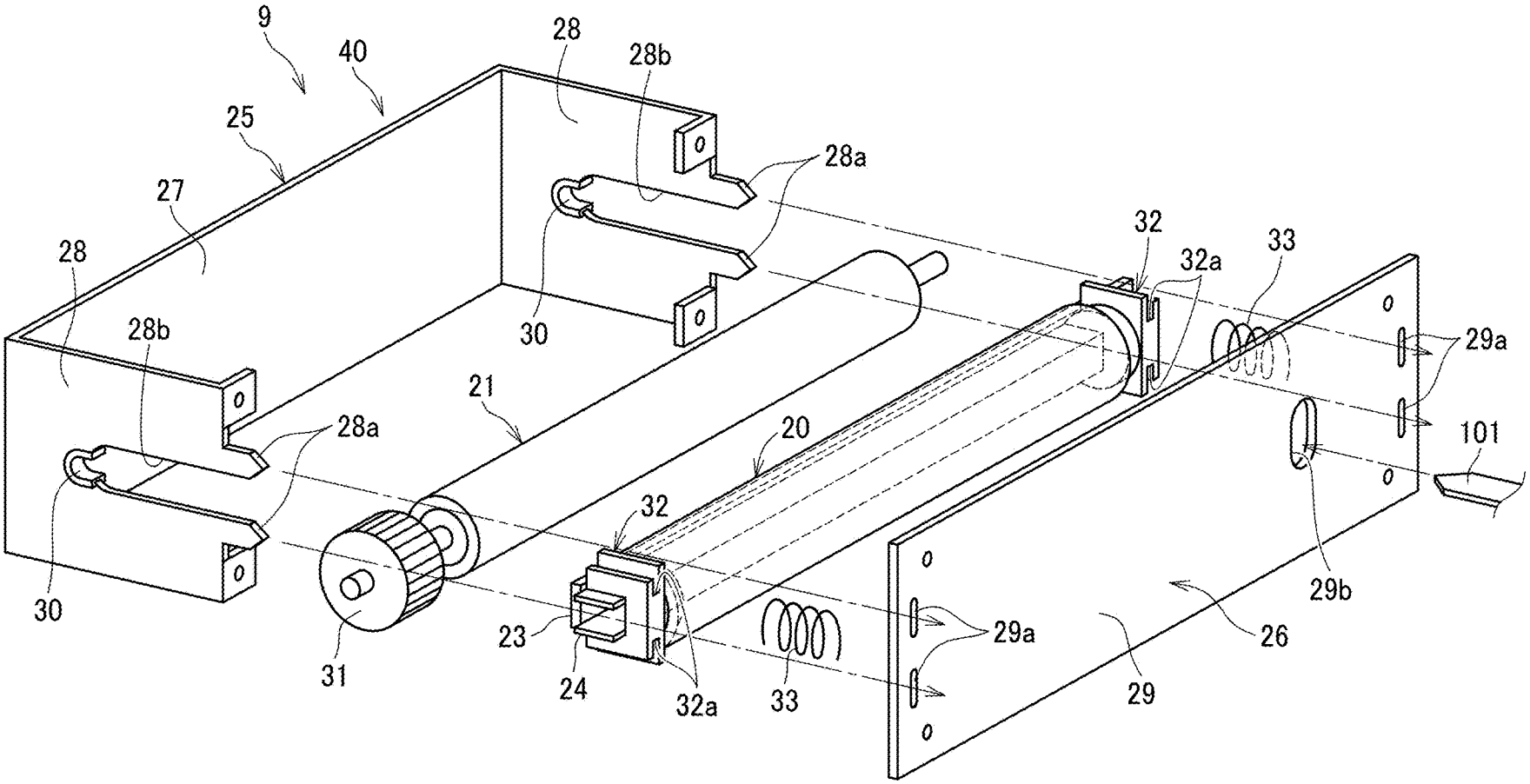
FIG. 4 is an exploded perspective view of the fixing device.

FIG. 3 is a perspective view of the fixing device 9 according to the present embodiment, and FIG. 4 is an exploded perspective view thereof.

As illustrated in FIGS. 3 and 4, the fixing device 9 according to the present embodiment includes a device frame 40 formed in a rectangular frame shape. The device frame 40 includes a first device frame 25 integrally including a pair of side walls 28 and a front wall 27, and a second device frame 26 including a rear wall 29. The first device frame 25 and the second device frame 26 are assembled by engaging a plurality of engagement protrusions 28*a* provided on the side walls 28 with a plurality of engagement holes 29*a* provided on the rear wall 29.

The fixing belt 20 and the pressure roller 21 are supported by the pair of side walls 28. Therefore, the side walls 28 include insertion grooves 28*b* through which the rotation shaft of the pressure roller 21 and the like are inserted. The insertion grooves 28*b* include abutment portions that open at one side (rear wall 29 side) thereof and do not open at the opposite side. The abutment portions include bearings 30 that rotatably support the rotation shaft of the pressure roller 21. In a state where the pressure roller 21 is supported by the side walls 28, a drive transmission gear 31 provided at one axial end of the pressure roller 21 is disposed in a state of being exposed to the outside of the corresponding side wall 28. Therefore, when the fixing device 9 is mounted in the main body of the image forming apparatus, the drive transmission gear 31 is connected to a gear provided in the main body of the image forming apparatus. As a result, the driving force can be transmitted from the drive source to the pressure roller 21. The drive transmission member connecting the drive source in the main body and the pressure roller 21 is not limited to the drive transmission gear 31, and may be a belt mechanism having a belt and a pulley, a coupling mechanism, or the like.

A pair of supporting members 32 that supports the fixing belt 20, the heater holder 23, the stay 24, and the like is provided at both longitudinal ends of the fixing belt 20. The supporting members 32 have guide grooves 32*a* formed therein. When the supporting members 32 are inserted into the insertion grooves 28*b* of the side walls 28 from the state illustrated in FIG. 4, the guide grooves 32*a* of the supporting members 32 engage with the edges of the insertion grooves 28*b*, and the supporting members 32 are assembled to the corresponding side walls 28. As a result, the fixing belt 20, the heater 22, the heater holder 23, and the stay 24 are supported by the side walls 28 via the supporting members 32. A pair of springs 33 as biasing members is provided between the supporting members 32 and the rear wall 29. The supporting members 32 are biased toward the front wall 27 by the biasing force of the springs 33, so that the fixing belt 20 is pressed against the pressure roller 21 to form the nip portion N.

The rear wall 29 includes a hole 29*b* as a positioning portion. On the other hand, the main body of the image forming apparatus includes a protrusion 101 (see FIG. 4) as a positioning portion. When the protrusion 101 is inserted into the hole 29*b* of the fixing device 9, the protrusion 101 and the hole 29*b* are fitted, so that the fixing device main body is positioned with respect to the image forming apparatus main body. The hole 29*b* is preferably provided at a position closer to any one end than the center of the rear wall 29 along the length. By providing the hole 29*b* at such a position, the device frame 40 is allowed to expand and contract longitudinally in accordance with temperature changes at the end without the hole 29*b*, which restrains the device frame 40 from being distorted.

Figure 5:
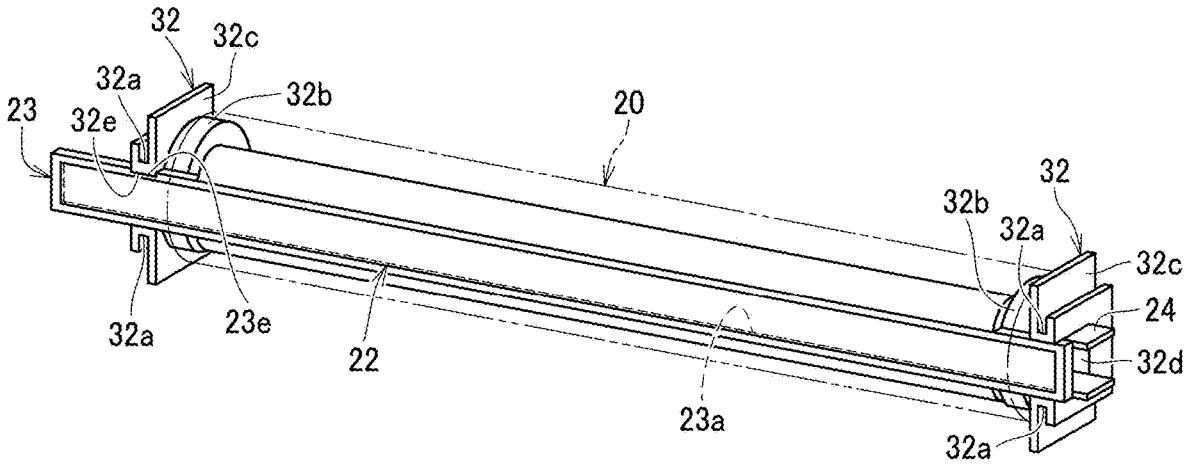
FIG. 5 is a perspective view of a heating unit included in the fixing device.
Figure 6:
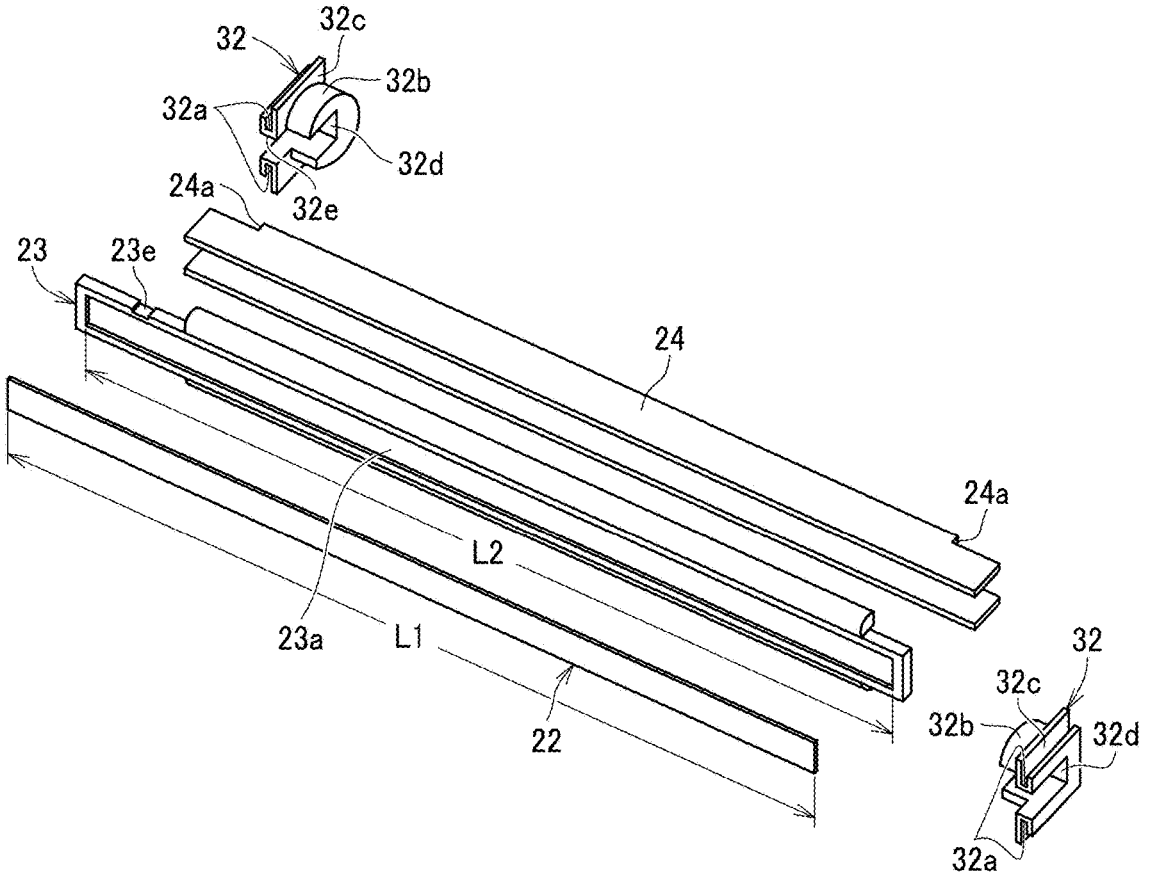
FIG. 6 is an exploded perspective view of the heating unit.

FIG. 5 is a perspective view of the heating unit, and FIG. 6 is an exploded perspective view of the heating unit.

As illustrated in FIG. 5, the heater 22 and the heater holder 23 are arranged longitudinally in the longitudinal direction of the fixing belt 20 (or the axial direction of the pressure roller 21) in a state of being assembled in the fixing belt 20. Similarly, the stay 24 is arranged longitudinally in the longitudinal direction of the fixing belt 20.

As illustrated in FIGS. 5 and 6, the heater holder 23 includes a rectangular housing recess 23*a* for housing the heater 22. The housing recess 23*a* is formed in substantially the same shape and size as the heater 22. However, a longitudinal dimension L2 of the housing recess 23*a* is set to be slightly longer than a longitudinal dimension L1 of the heater 22. As a result, even if the heater 22 extends in its longitudinal direction due to thermal expansion, interference between the heater 22 and the housing recess 23*a* can be avoided, and distortion of the heater 22 and the heater holder 23 can be restrained.

The pair of supporting members 32 includes C-shaped belt support portions 32*b*, a flange-shaped belt regulating portions 32*c*, and support recesses 32*d*. The belt support portions 32*b* are inserted inside both longitudinal ends of the fixing belt 20. As a result, the fixing belt 20 is supported by the belt support portions 32*b* in a so-called free belt manner (in a state in which basically no tension is generated in the fixing belt 20 at the time of non-rotation). On the other hand, the belt regulating portions 32*c* are not inserted into the fixing belt 20, and are disposed so as to face the longitudinal ends of the fixing belt 20. As a result, even if the fixing belt 20 moves (deviates) in the longitudinal direction, the longitudinal ends of the fixing belt 20 comes into contact with the belt regulating portions 32*c*, whereby the movement (deviation) of the fixing belt 20 in the longitudinal direction is regulated. Portions near both longitudinal ends of the heater holder 23 and the stay 24 are inserted into the support recesses 32*d*. Accordingly, the heater holder 23 and the stay 24 are supported by the pair of supporting members 32.

As illustrated in FIGS. 5 and 6, a positioning recess 23*e* as a positioning portion is provided on one longitudinal end portion with respect to the center of the heater holder 23. When a fitting portion 32*e* of the supporting member 32 on the left side in FIGS. 5 and 6 is fitted to the positioning recess 23*e*, the heater holder 23 and the supporting member 32 are positioned. On the other hand, the fitting portion 32*e* is not provided in the supporting member 32 on the right side in FIGS. 5 and 6. Therefore, on the right side in the drawings, the supporting member 32 is not longitudinally positioned with respect to the heater holder 23. As described above, in the present embodiment, since the heater holder 23 is positioned with respect to the supporting member 32 only on one end in the longitudinal direction of the heater holder 23, the heater holder 23 is allowed to expand and contract in accordance with temperature changes.

As illustrated in FIG. 6, the stay 24 includes stepped portions 24*a* that regulate the movement of the stay 24 in the vicinity of both longitudinal ends. When the stepped portions 24*a* abut on the supporting members 32, the longitudinal movement of the stay 24 with respect to the supporting members 32 is regulated. However, at least one of the stepped portions 24*a* is disposed with a gap (backlash) from the corresponding supporting member 32. As described above, at least one of the stepped portions 24*a* is disposed with a gap from the supporting member 32, so that the stay 24 is allowed to expand and contract in accordance with temperature changes.

Figure 7:
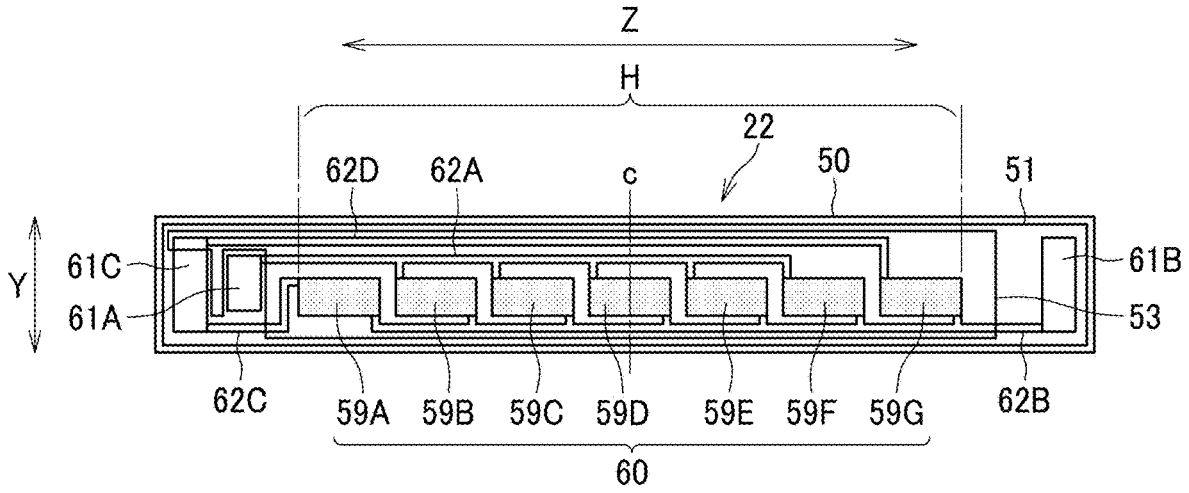
FIG. 7 is a plan view of a heater according to the present embodiment.
Figure 8:
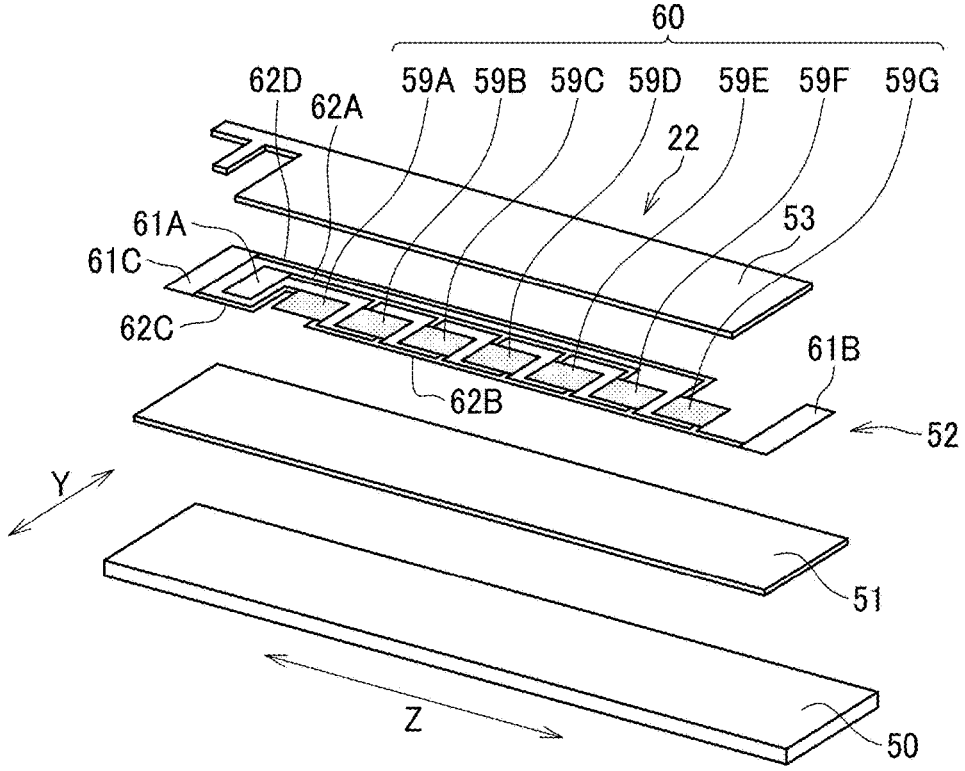
FIG. 8 is an exploded perspective view of the heater.

FIG. 7 is a plan view of the heater 22 according to the present embodiment, and FIG. 8 is an exploded perspective view thereof.

As illustrated in FIG. 8, the first insulating layer 51, the conductor layer 52, and the second insulating layer 53 are laminated on base 50 of the heater 22. The conductor layer 52 includes a plurality of resistive heat generators 59A to 59G, a plurality of electrode portions 61A to 61C, and a plurality of power supply lines (conductive portions) 62A to 62D.

The plurality of resistive heat generators 59A to 59G is provided on the base 50 with the first insulating layer 51 in between. In FIGS. 7 and 8, assuming that an arrow Z direction in which the resistive heat generators 59A to 59G are arranged is the "longitudinal direction" of the heater 22 and the base 50, the resistive heat generators 59A to 59G are arranged in a line in the longitudinal direction Z of the base 50. The resistive heat generators 59 form the heat generation portion 60 on the base 50. The resistive heat generators 59A to 59G are arranged at intervals in the longitudinal direction Z. Therefore, an insulating region (second insulating layer 53) is interposed between the adjacent resistive heat generators 59A to 59G.

The resistive heat generators 59A to 59F are electrically connected to any two of the plurality of electrode portions 61A to 61C via the plurality of power supply lines 62A to 62D. Referring to FIGS. 7 and 8, assuming that a direction Y intersecting the longitudinal direction Z along the surface of the base 50 on which the resistive heat generators 59 are provided is a "lateral direction", the power supply lines 62A to 62D are arranged at intervals left in the lateral direction Y.

As illustrated in FIG. 7, the entire resistive heat generators 59A to 59G and most parts of the power supply lines 62A to 62D are covered with the second insulating layer 53 to ensure insulation. On the other hand, the electrode portions 61A to 61C are portions to which connectors to be described later as power supply members are connected, and thus the electrode portions 61A to 61C are hardly covered with the second insulating layer 53 and are exposed.

The resistive heat generators 59A to 59G are formed by, for example, screen-printing a paste prepared with silver palladium (AgPd), glass powder, or the like on the base 50, and then firing the base 50. As a material of the resistive heat generators, a resistive material such as a silver alloy (AgPt) or ruthenium oxide ($RuO_2$) is used.

The electrode portions 61A to 61C and the power supply lines 62A to 62D are formed of a conductor having a resistance value smaller than that of the resistive heat generators. Specifically, the electrode portions 61A to 61C and the power supply lines 62A to 62D are formed by screen printing a material such as silver (Ag) or silver palladium (AgPd) on the base 50.

Figure 9:
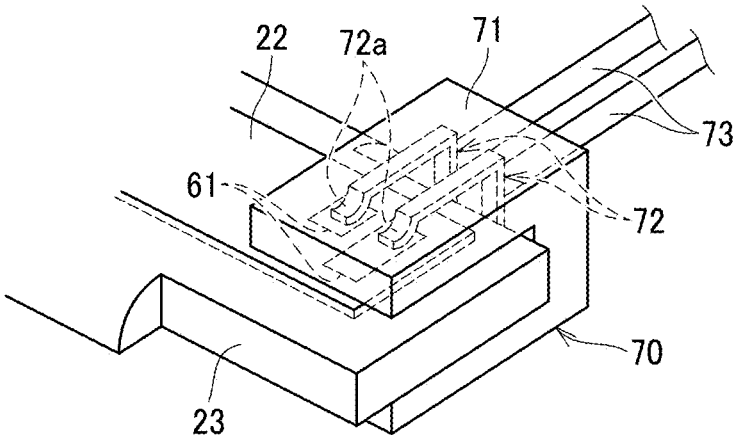
FIG. 9 is a perspective view illustrating a state in which a connector is connected to the heater.

FIG. 9 is a perspective view of a connector 70 connected to the heater 22.

As illustrated in FIG. 9, the connector 70 includes a resin housing 71 and a plurality of contact terminals 72. The contact terminals 72 are elastic members having conductivity such as leaf springs. The contact terminals 72 are provided in the housing 71. The contact terminals 72 are connected to power supply harnesses 73.

As illustrated in FIG. 9, the connector 70 is attached so as to sandwich the heater 22 and the heater holder 23 together. Thus, the heater 22 and the heater holder 23 are held by the connector 70. In this state, the tips (contact portions 72*a*) of the contact terminals 72 elastically contact (press) the corresponding electrode portions 61, whereby the contact terminals 72 and the electrode portions 61 are electrically connected. In this state, electric power is supplied from a power source provided in the main body of the image forming apparatus to the resistive heat generators 59A to 59G via the connector 70, so that the resistive heat generators 59A to 59G generate heat.

Hereinafter, the configuration of the heater 22 according to the present embodiment will be described in more detail with reference to FIG. 10.

Figure 10:
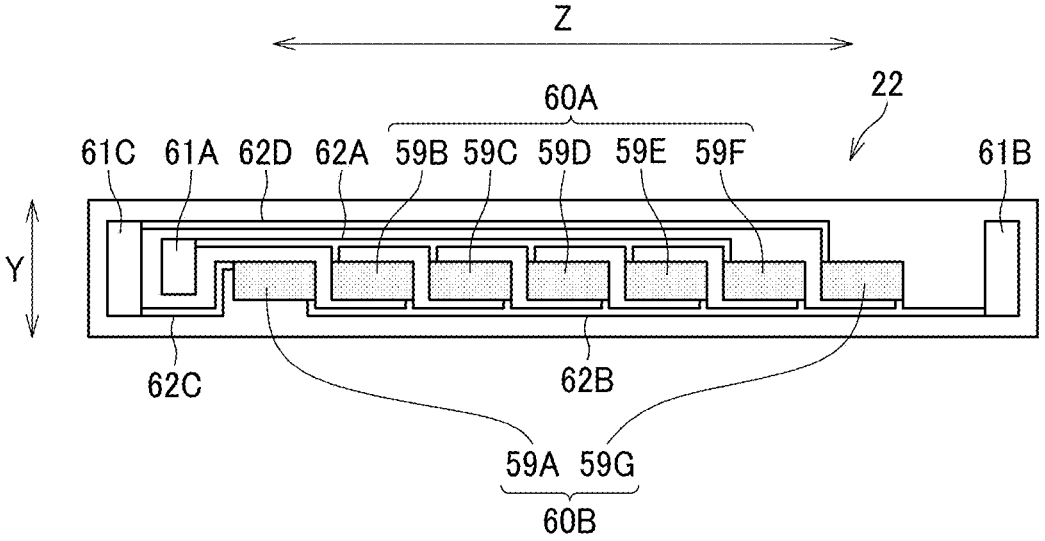
FIG. 10 is a plan view of the heater.

As illustrated in FIG. 10, the heater 22 according to the present embodiment includes seven resistive heat generators 59A to 59G, three electrode portions 61A to 61C, and four power supply lines 62A to 62D connecting these elements and portions. Among the three electrode portions 61A to 61C, two electrode portions 61A and 61C are disposed on one end portion (left end portion in FIG. 10) of the base 50 in the longitudinal direction Z, and the remaining one electrode portion 61B is disposed on the other end portion (right end portion in FIG. 10) of the base 50 in the longitudinal direction Z. The resistive heat generators 59A to 59G are disposed between the electrode portions 61A and 61C on the one end portion and the electrode portion 61B on the other end portion, and are electrically connected to any one of the electrode portions 61A and 61C on the one end portion and the electrode portion 61B on the other end portion.

Specifically, among the seven resistive heat generators 59A to 59G, the five resistive heat generators 59B to 59F other than the two at the both ends are connected in parallel to the first electrode portion 61A on the left side via the first power supply line 62A. On the other hand, the two resistive heat generators 59A and 59G at the both ends are connected in parallel to the third electrode portion 61C on the left side via the third power supply line 62C or the fourth power supply line 62D. All of the seven resistive heat generators 59A to 59G are connected in parallel to the right second electrode portion 61B via the second power supply line 62B.

As described above, the resistive heat generators 59B to 59F other than the two at the both ends and the resistive heat generators 59A and 59G at the both ends are connected to the different electrode portions 61A and 61C, respectively, so that the resistive heat generator groups can generate heat independently of each other. That is, when a voltage is applied to the first electrode portion 61A and the second electrode portion 61B to generate a potential difference between these electrode portions 61A and 61B, a current flows only into the resistive heat generators 59B to 59F other than the two at the both ends. Therefore, only a first heat generation portion 60A including the resistive heat generators 59B to 59F other than the two at the both ends generates heat. On the other hand, when a voltage is applied to the third electrode portion 61C and the second electrode portion 61B to generate a potential difference between these electrode portions 61C and 61B, a current flows only into the resistive heat generators 59A and 59G at the both ends. Therefore, in this case, only the second heat generation portion 60B including the resistive heat generators 59A and 59G at the both ends generates heat. When a voltage is applied to all the electrode portions 61A to 61C to generate potential differences between the first electrode portion 61A and the second electrode portion 61B and between the third electrode portion 61C and the second electrode portion 61B, a current flows through all the resistive heat generators 59A to 59G. Therefore, in this case, both the first heat generation portion 60A and the second heat generation portion 60B generate heat.

As described above, in the present embodiment, the heat generation range can be changed by changing the electrode portions to which the voltage is applied. For example, in a case where a small-sized paper sheet of A4 or smaller is conveyed, only the first heat generation portion 60A is caused to generate heat, and in a case where a large-sized paper sheet of A3 or larger is conveyed, both the first heat generation portion 60A and the second heat generation portion 60B are caused to generate heat, so that the heat generation range according to the paper sheet width can be achieved.

Here, variations in temperature (temperature distribution deviations) occurring in the heater 22 according to the present embodiment will be described.

In general, in a heater in which a resistive heat generator and an electrode portion are connected via a power supply line, when the resistive heat generator is caused to generate heat, slight heat is generated in the power supply line by energization to the power supply line. Therefore, the temperature distribution of the heater may vary depending on the heat generation distribution of the power supply line. In particular, if the width of the power supply line is reduced in accordance with the miniaturization of the heater, or if the current flowing into the heater is increased in accordance with the increasing speed of the image forming apparatus, the amount of heat generated in the power supply line also increases, and thus the influence thereof cannot be ignored.

Figure 11:
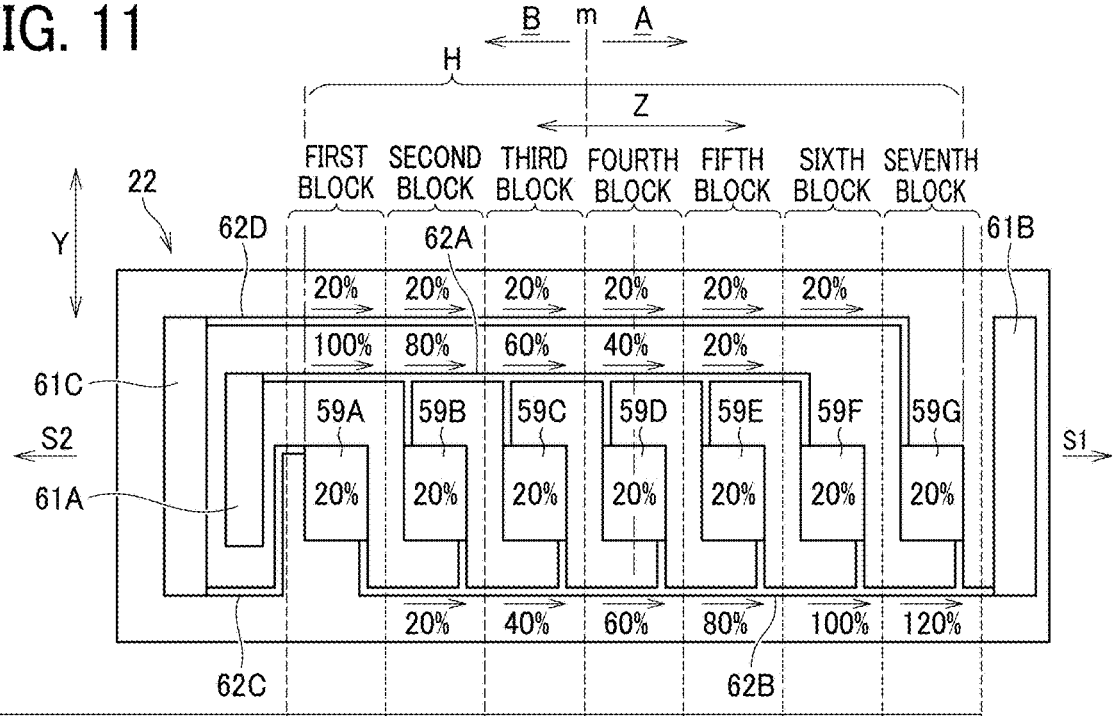
FIG. 11 is a diagram illustrating the amounts of heat generation of power supply lines in blocks in a case where all resistive heat generators are caused to generate heat.
Figure 11:
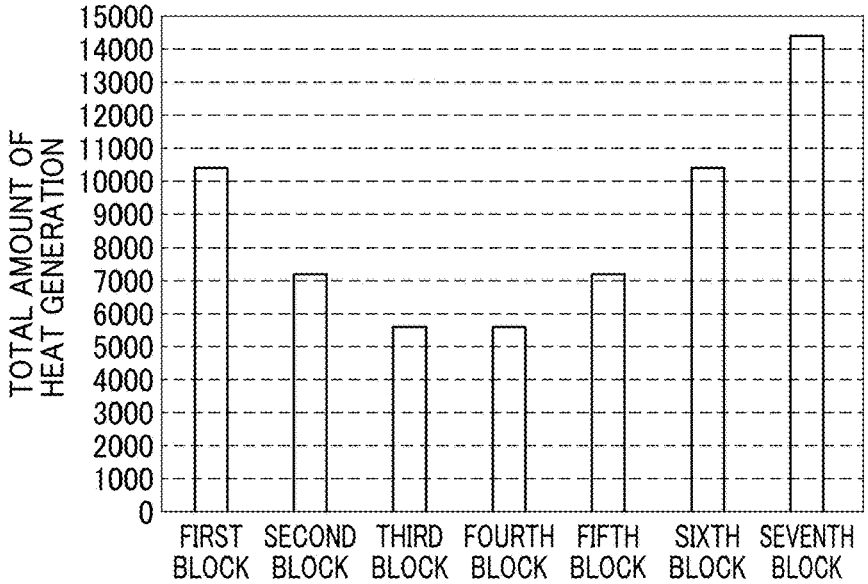

FIG. 11 illustrates the amounts of heat generated in one or more power supply lines and total values thereof in blocks partitioned in correspondence with the resistive heat generators 59A to 59G when the current flows by 20% to all the resistive heat generators 59A to 59G. Although FIG. 11 illustrates a state in which the current flows from the first electrode portion 61A toward the second electrode portion 61B, the current flowing into the heater 22 is not limited to direct current but may be alternating current.

Here, since the amount of heat generation (W) is expressed by the following formula (1), in the table of FIG. 11, the amounts of heat generation are each calculated as the square of the current (I) flowing into the power supply line for convenience. Therefore, the calculated amounts of heat generation are merely values calculated in a simple manner, and are different from the actual amounts of heat generation. In the present embodiment, the respective portions of the power supply lines 62A, 62B, and 62D extending in the lateral direction Y are short, and the amounts of heat generated in these portions extending in the lateral direction Y are small. Thus, the amounts of heat generated in these portions are ignored. Therefore, here, only the amounts of heat generated in the portions extending in the longitudinal direction Z are calculated.

[Mathematical formula 1]

$$W\text{ (amount of heat generation)} = R\text{ (resistance)} \times I^2\text{ (current)} \quad (1)$$

A method of calculating the amounts of heat generation will be described by taking the first block and the second block in FIG. 11 as an example. In the first block, the current flowing into the first power supply line 62A is 100% and the current flowing into the fourth power supply line 62D is 20%, so that the total value of the squares, 10400 (10,000+400), is the total amount of heat generation of the power supply lines in the first block. In the second block, the current flowing into the first power supply line 62A is 80%, the current flowing into the second power supply line 62B is 20%, and the current flowing into the fourth power supply line 62D is 20%. Therefore, the sum of the squares, 7200 (6400+400+400), is the total amount of heat generation of the power supply lines in the second block. In the other blocks, the amounts of heat generation are calculated by the same calculation method.

The total amounts of heat generation in the blocks are represented on the vertical axis in the graph of FIG. 11. As illustrated in this graph, in the present embodiment, the total amounts of heat generation of the power supply lines are larger in the blocks at both ends, and are conversely lower in the blocks in the center part. In addition, the total amounts of heat generation of the power supply lines in the blocks symmetric with respect to the center (for example, the first block and the seventh block) are also different. Specifically, in a heat generation region H in which the resistive heat generators 59A to 59G are arranged, when one side in the longitudinal direction Z with respect to a longitudinal center m is referred to as "one side A" and the other side opposite to the one side A with respect to the longitudinal center m is referred to as "the other side B", the one side A has a higher temperature than the other side B. As described above, since the heat generation distribution of the power supply line varies in the longitudinal direction Z, this variation also causes variation in the heat generation distribution of the heater.

Such variations in temperature due to heat generation by the power supply lines can occur not only when all the resistive heat generators generate heat (in the example illustrated in FIG. 11) but also when some of the resistive heat generators generate heat. For example, in a case where unintended shunt current occurs in a power supply line, the current also flows in a path through which the current has not flowed so far, and thus, there is a possibility that a variation in temperature occurs. Unintended shunt current is likely to occur, for example, when the resistance value of a power supply line increases as a result of reducing the width of the power supply line in the lateral direction of the heater in response to the miniaturization of the heater. In addition, unintended shunt current is also likely to occur in a case where the resistance value of a resistive heat generator is reduced in order to increase the amount of heat generation of the resistive heat generator in accordance with the increasing speed of the image forming apparatus. That is, when the resistance value of a power supply line and the resistance value of a resistive heat generator are relatively close to each other along with the miniaturization or increasing speed or the image forming apparatus, the current can flow into a path through which the current has not flowed so far, which may cause variations in temperature.

Figure 12:
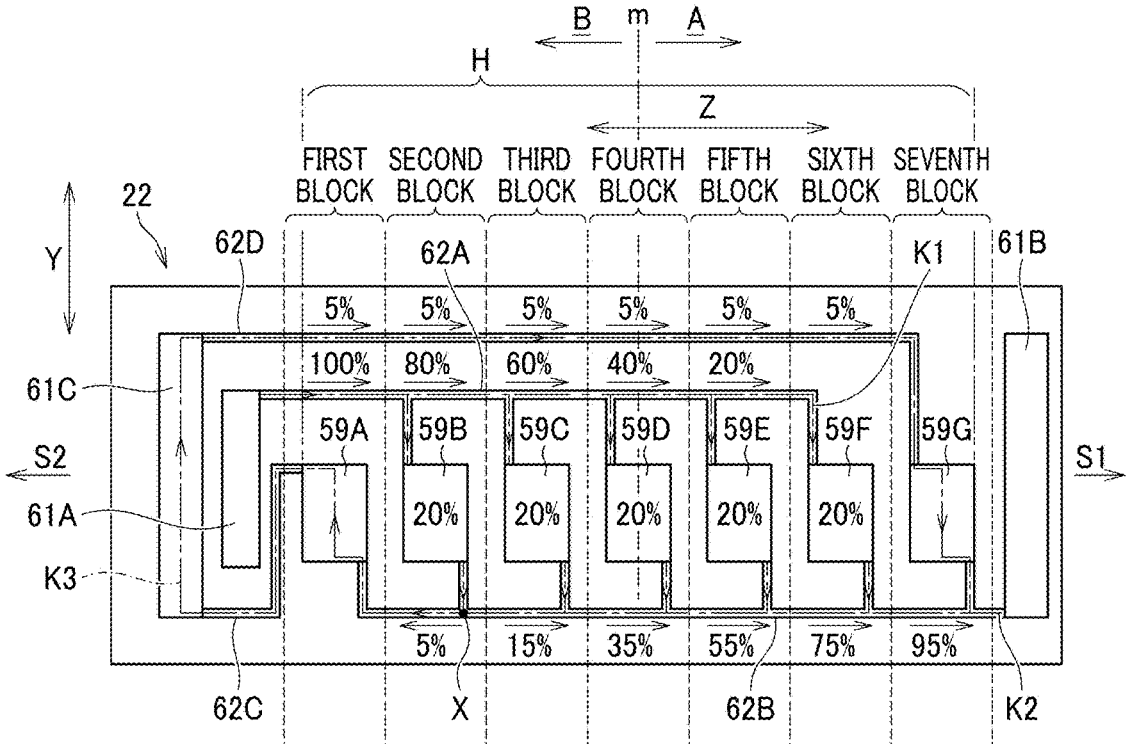
FIG. 12 is a diagram illustrating the amount of heat generation of the power supply lines in the blocks in a case where only some of the heat generation portions generate heat.
Figure 12:
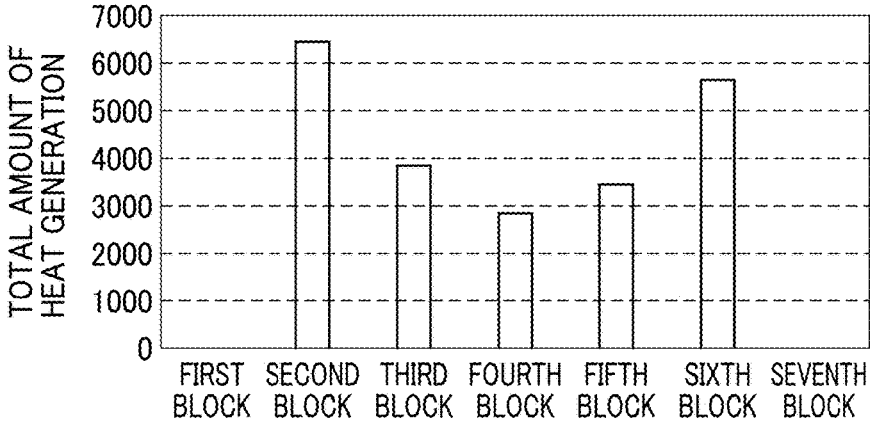

FIG. 12 illustrates an example of a case where unintended shunt current occurs in the present embodiment.

In this example, current flows 20% each into the resistive heat generators 59B to 59F (first heat generation portion 60A) other than the two at the both ends. However, in the second resistive heat generator 59B from the left in the drawing, a part (5%) of the current having passed through the resistive heat generator 59B flows to the side (left side in the drawing) opposite to the second electrode portion 61B at a branch portion X of the second power supply line 62B ahead of the resistive heat generator 59B, and unintended shunt current occurs. The shunt current passes through the resistive heat generator 59A at the left end in FIG. 12, and further passes through the resistive heat generator 59G at the right end via the third power supply line 62C, the third electrode portion 61C, and the fourth power supply line 62D, and then joins the second power supply line 62B. Also in this case, the current flowing into the heater 22 is not limited to direct current, and may be alternating current.

The table and graph in FIG. 12 indicate the amounts of heat generated in one or more power supply lines and total values thereof in the blocks in a case where unintended shunt current occurs. The method of calculating the amounts of heat generation is the same as the method described with reference to the example illustrated in FIG. 11.

As illustrated in the table and graph in FIG. 12, also in this case, the total amounts of heat generation of the power supply lines are larger in the blocks at both ends, and conversely, are lower in the blocks in the center parts, thereby resulting in variations. However, in the case of FIG. 12, contrary to FIG. 11, the temperatures of the blocks on the left side (the other side B) of the graph become higher than the temperatures of the blocks on the right side (the one side A) of the graph.

As described above, in the fixing device according to the present embodiment, the temperature distribution of the heater varies according to the amounts of heat generation of the power supply lines generated in the blocks. If the temperature distribution of the heater varies, the surface temperature of the fixing belt heated by the heater also varies, and there is a possibility that the quality of the fixed image deteriorates due to gloss unevenness or the like. In particular, in a case where all the resistive heat generators 59A to 59G are caused to generate heat (in the case of the example illustrated in FIG. 11), the temperature difference between the one side and the other side in the longitudinal direction becomes large, and thus, it is necessary to effectively cool the side of the fixing device where the temperature becomes high.

Figure 13:
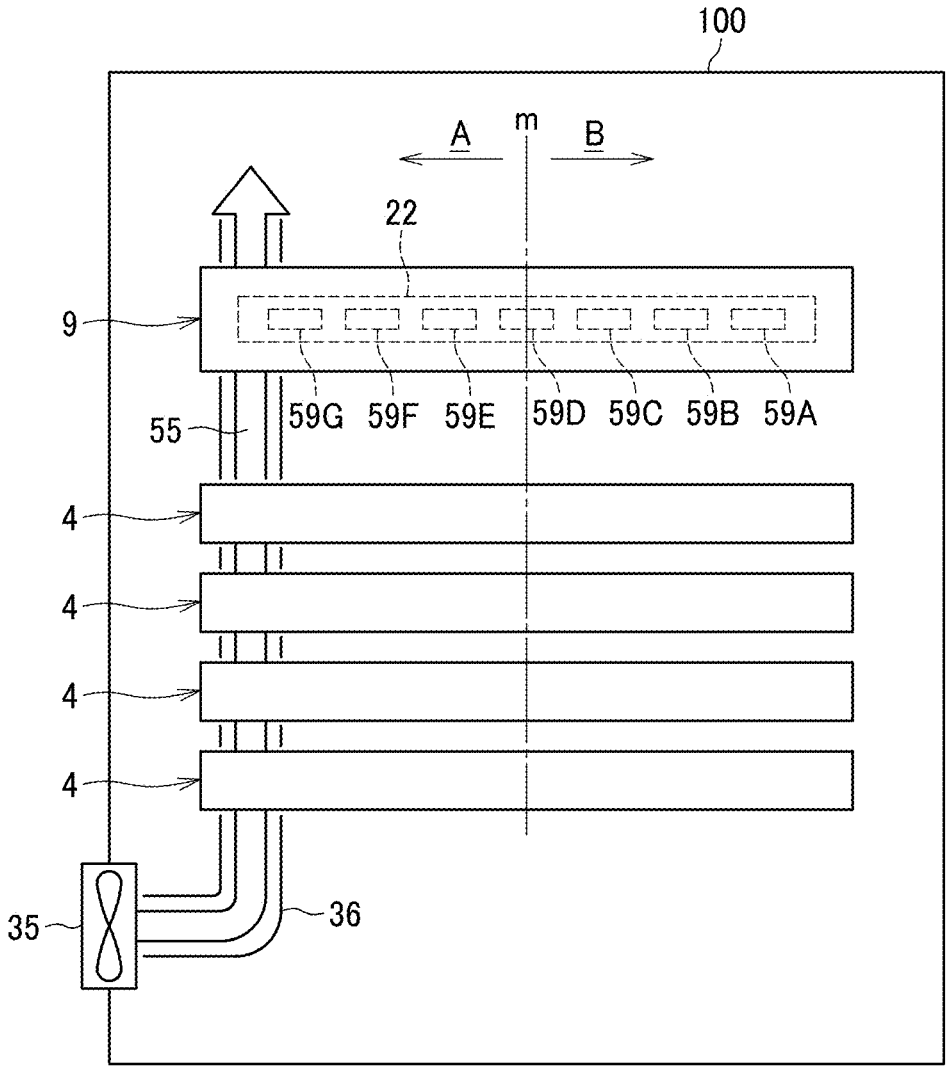
FIG. 13 is a schematic diagram of the image forming apparatus according to the present embodiment as viewed from above.

Therefore, in the image forming apparatus according to the present embodiment, in order to effectively cool the side of the fixing device where the temperature is high, as illustrated in FIG. 13, a cooling airflow 55 is generated on the side of the fixing device 9 where the temperature is high.

FIG. 13 is a schematic top view of the image forming apparatus 100 according to the present embodiment, and the arrow in the drawing indicates the airflow 55 and its flowing direction. In this case, in the fixing device 9 illustrated in FIG. 13, a portion on the left side of the longitudinal center m of the heat generation region of the heater 22 is on the side (the one side A) where the temperature becomes relatively high. That is, the resistive heat generator 59G (see FIG. 11) of the seventh block having the highest temperature when all the resistive heat generators 59A to 59G are caused to generate heat is disposed at the left portion of the fixing device 9.

As described above, by generating the airflow on the side where the temperature of the fixing device 9 becomes high (the one side A), the side where the temperature becomes high can be effectively cooled, so that the variations in temperature in the longitudinal direction can be restrained.

In the present embodiment, a blower fan 35 is provided as an airflow generation device that generates the airflow 55. A suction fan may be provided instead of the blower fan 35. In the image forming apparatus 100, a flow path forming member 36 such as a duct or a partition plate is provided to guide an airflow from the blower fan 35 to the fixing device 9.

In order to specify which one of the one side A and the other side B of the fixing device 9 has a higher temperature, the total values of squares of currents flowing into one or more power supply lines at arbitrary longitudinal positions in the heat generation region H may be calculated and compared with each other. In the example illustrated in FIG. 11, the largest total value (the total value of the seventh block) of the total values of squares of the currents flowing into the one or more power supply lines at arbitrary longitudinal positions on the one side A is larger than the largest total value (the total value of the first block) of the total values of squares of the currents flowing into the one or more power supply lines at arbitrary longitudinal positions on the other side B. Therefore, the one side A is specified as the side where the temperature becomes high.

The method of specifying the side of the fixing device 9 where the temperature is high is not limited to comparing the total values of squares of the currents flowing into the power supply lines, and may be detecting the temperature of the fixing device 9 or the heater 22. For example, temperature sensors that detect the temperature of the heater 22 may be disposed at positions symmetrical to each other on the one side A and the other side B, and the temperatures detected by these temperature sensors may be compared to specify the side on which the temperature is high.

As illustrated in FIG. 13, in the image forming apparatus 100 according to the present embodiment, the airflow 55 sent from the blower fan 35 is used as a means for cooling the plurality of developing devices 4 as well as the fixing device 9. In general, it is known that the temperature of a developing device rises due to frictional heat generated between a developer and a conveyance screw, frictional heat generated between the conveyance screw and a seal member, or the like. When the temperature of the developing device rises, the developer contained in the developing device is melted, and the melted developer is solidified to generate aggregates, which may cause an abnormal image. Therefore, it is necessary to cool the developing device. However, the degree of temperature rise in the developing device is not uniform over the entire developing device, and varies depending on the portions. Therefore, in order to effectively restrain an abnormal image due to a temperature rise, it is necessary to specify a portion in which the temperature is particularly high in the developing device and to efficiently cool the portion.

As a method of cooling both the fixing device and the developing device, for example, as in JP-2007-279263-A described above, individual airflow paths dedicated to these devices are provided, and airflows are generated in portions of the fixing device and the developing device where the temperatures are high. However, this method requires large spaces for installing the airflow paths, which causes problems of increased size and cost of the image forming apparatus.

Therefore, in the present embodiment, as illustrated in FIG. 13, the side where the temperatures of the fixing device 9 and the developing devices 4 become high is arranged on the left side of the drawing, and the side opposite to the side where the temperatures become high is arranged on the right side of the drawing. As described above, the side where the temperature of the fixing device 9 increases and the side where the temperatures of the developing devices 4 become high are disposed on the same side (the one side A), so that the fixing device 9 and the developing devices 4 can be effectively cooled only by generating the cooling airflow 55 only on one side (the one side A) of the devices. As a result, portions of the fixing device 9 and the developing devices 4 where the temperatures become high can be effectively cooled using one airflow path and one airflow generation device, so that the number of airflow paths and airflow generation devices can be decreased, and the size and cost of the image forming apparatus can be reduced.

In general, since the amount of heat generation in the fixing device is larger than the amount of heat generation in the developing device, as illustrated in FIG. 13, the developing devices 4 are preferably disposed on the upstream side of the fixing device 9 in the direction of the airflow. That is, on the contrary, if the fixing devices are on the upstream side of the developing device, the airflow heated by the heat of the fixing device is sent to the developing devices, so that the effect of cooling the developing devices is deteriorated. On the other hand, when the developing devices 4 are disposed on the upstream side of the fixing device 9, the airflow heated by the fixing device 9 does not flow to the developing devices 4, so that the developing devices 4 can be effectively cooled.

Figure 14:
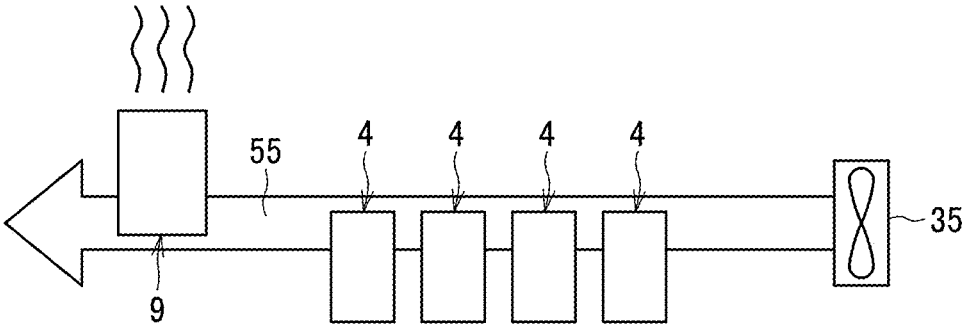
FIG. 14 is a diagram of the fixing device and developing devices as viewed from the horizontal direction.

In addition, since heat (hot air) generated by the fixing device basically moves upward in the direction of gravity, the fixing device 9 may be shifted upward in the direction of gravity from the developing devices 4 as in the example illustrated in FIG. 14. In this case, since the developing devices 4 are less likely to be affected by the heat generated by the fixing device 9, the developing devices 4 can be effectively cooled.

Figure 15:
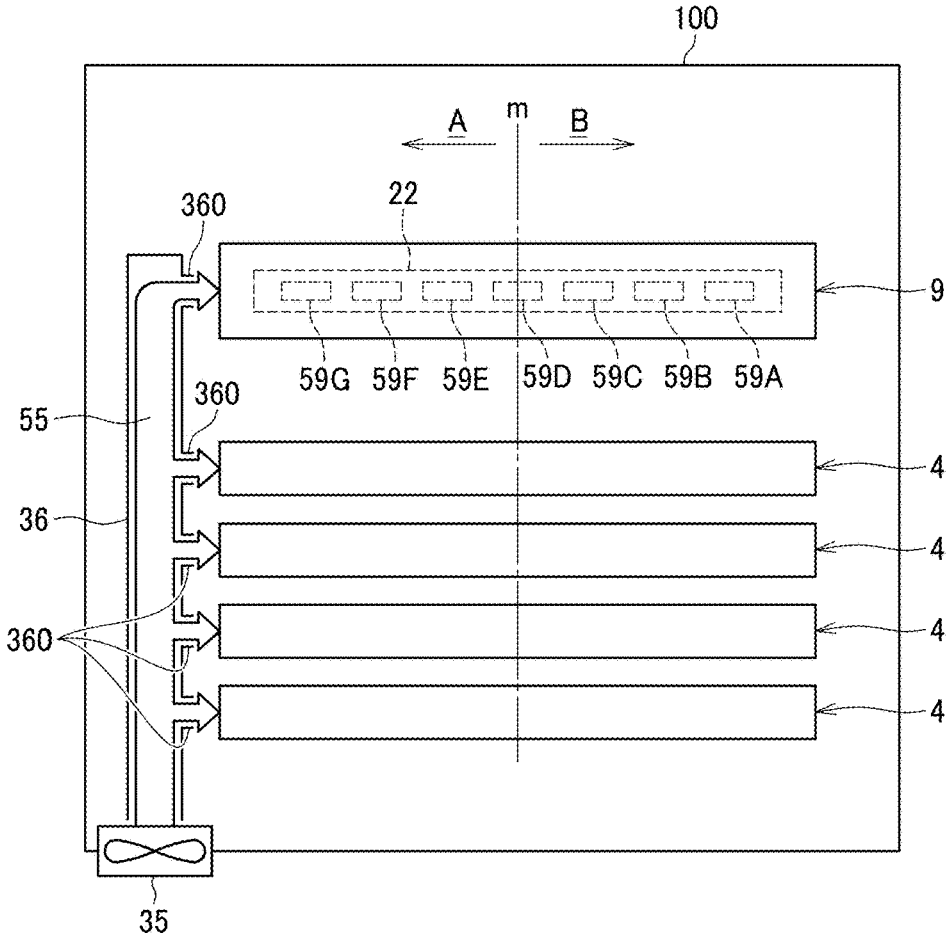
FIG. 15 is a diagram illustrating an example in which the flow path forming member has a plurality of openings through which an airflow is blown out.

Furthermore, as in the example illustrated in FIG. 15, the flow path forming member 36 that guides the airflow may be provided with a plurality of openings 360 that blows out a part of the airflow toward the fixing device 9 and the developing devices 4. In this case, since a part of the airflow is blown from the openings 360 to the fixing device 9 and the developing devices 4, these devices can be effectively cooled.

Hereinafter, a specific example of portions of a developing device where the temperature tends to be high will be described.

First, an example of a general arrangement of a developing device will be described with reference to FIG. 16.

Figure 16:
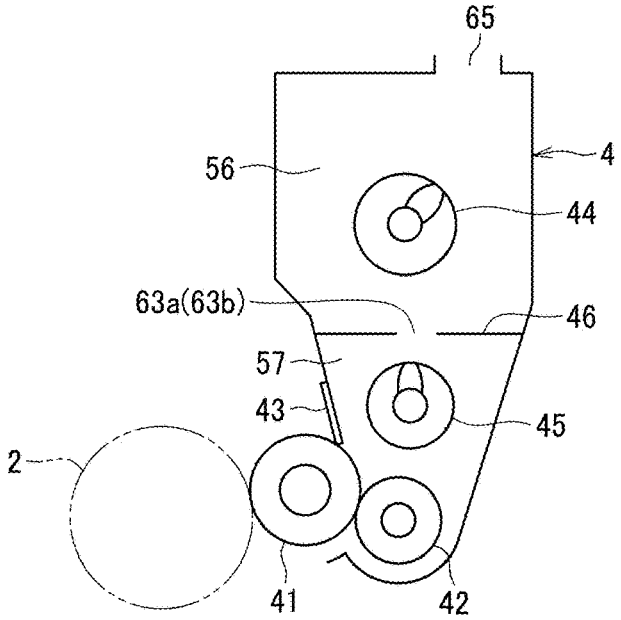
FIG. 16 is a diagram illustrating an example of a general arrangement of a developing device.

The developing device 4 illustrated in FIG. 16 includes a developing roller 41, a supply roller 42, a developing blade 43, and two conveyance screws 44 and 45.

The developing roller 41 is a developer bearing member that bears a developer on the surface. The developer may be a nonmagnetic one-component developer containing only nonmagnetic toner without containing a carrier, or may be a two-component developer in which nonmagnetic toner and a magnetic carrier are mixed. The developing roller 41 is disposed so as to face the photoconductor 2. When the developing roller 41 rotates, the developer borne on the surface thereof is conveyed to a position facing the photoconductor 2, and the developer is supplied to the photoconductor 2.

The supply roller 42 is a developer supply member that supplies the developer to the developing roller 41. The supply roller 42 is provided in contact with the surface (outer peripheral surface) of the developing roller 41. At a contact portion where the supply roller 42 and the developing roller 41 are in contact with each other, the developer is supplied from the rotating supply roller 42 to the developing roller 41.

The developing blade 43 is a developer regulating member that regulates the amount of developer on the developing roller 41. The leading end of the developing blade 43 is in contact with the surface of the developing roller 41 or disposed with a slight gap interposed therebetween. When the developer supplied onto the developing roller 41 passes through a position facing the leading end of the developing blade 43 along with the rotation of the developing roller 41, the thickness of the developer is regulated to a uniform thickness. Thereafter, the developer on the developing roller 41 is supplied to the surface of the photoconductor 2.

The two conveyance screws 44 and 45 are conveyance members that convey the developer in the developing device 4. In the example illustrated in FIG. 16, the internal space of the developing device 4 in which the developer is stored is divided by a partition wall 46 into an upper first storage space 56 and a lower second storage space 57. One conveyance screw 44 is disposed in the upper first storage space 56, and the other conveyance screw 45 is disposed in the lower second storage space 57. In addition, the partition wall 46 has through holes 63*a* and 63*b* provided in the vicinity of both axial ends of the conveyance screws 44 and 45. Therefore, when the conveyance screws 44 and 45 rotate and the developer is conveyed, the developer circulates in the first storage space 56 and the second storage space 57 through the through holes 63*a* and 63*b*.

In addition, the upper surface of the developing device 4 has a replenishment port 65 for replenishing a developer from a toner cartridge (developer storage container). The developer replenished from the toner cartridge is first stored in the first storage space 56 through the replenishment port 65. Then, the developer is conveyed by the conveyance screws 44 and 45 to circulate in the developing device 4. As a result, since the replenished new developer and the existing developer in the developing device 4 are mixed, the state of the developer (the ratio of the new developer) becomes uniform, and occurrence of defects such as color unevenness or surface staining can be prevented.

Figure 17:
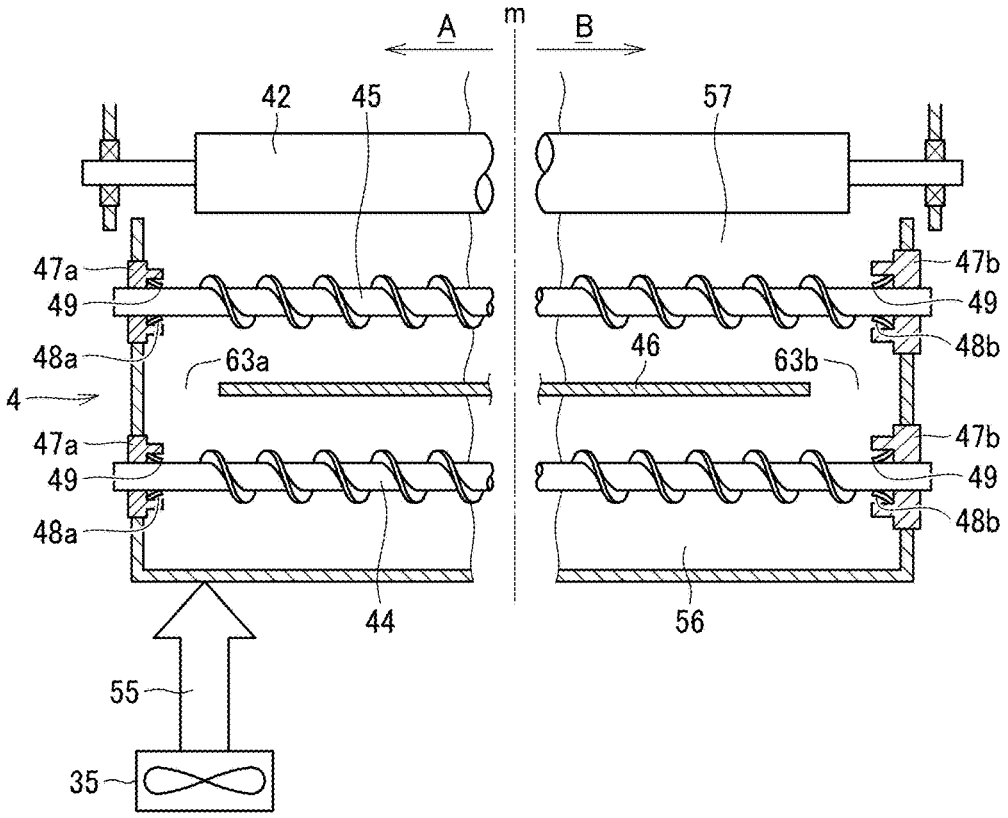
FIG. 17 is a diagram illustrating conveyance screws and their support structures.

FIG. 17 is a diagram illustrating the conveyance screws 44 and 45 and a support structure thereof.

As illustrated in FIG. 17, the conveyance screws 44 and 45 are each rotatably supported by a pair of bearings 47*a* and 47*b* on both axial end portions thereof. As the bearings 47*a* and 47*b*, various bearings such as rolling bearings or sliding bearings can be applied. Seal members 48*a* and 48*b* are provided on both axial end portions of the conveyance screws 44 and 45 to prevent the developer from entering the bearings 47*a* and 47*b*.

Here, since the seal members 48*a* and 48*b* are fixed so as not to rotate, when the conveyance screws 44 and 45 rotate, the seal members 48*a* and 48*b* slide relative to the conveyance screws 44 and 45. At this time, frictional heat is generated in sliding portions 49 between the conveyance screws 44 and 45 and the seal members 48*a* and 48*b*, so that the temperature of the developing device 4 rises by the frictional heat.

Part of the frictional heat generated in the sliding portions 49 is dissipated via the bearings 47*a* and 47*b*. However, the amounts of heat radiation from the bearings 47*a* and 47*b* vary depending on the volumes of the bearings 47*a* and 47*b*. That is, as the volumes of the bearings decrease, the heat capacities decrease, and thus the amounts of heat dissipation decrease. Therefore, when the amounts of heat generated in the sliding portions 49 are the same, the temperature is more likely to rise as the volumes of the bearings are smaller.

In a developing device, one of a pair of bearings provided on both end portions of a conveyance screw may be made smaller than the other due to convenience of component layout or the like. In this case, the temperature tends to become high on the end where the bearing having a smaller volume is provided. In the example illustrated in FIG. 17, among the bearings 47*a* and 47*b* supporting the conveyance screws 44 and 45, the bearings 47*a* on the left side in the drawing are smaller than the bearings 47*b* on the right side in the drawing. Therefore, in the example illustrated in FIG. 17, the temperature is likely to rise in the left portion of the developing device 4.

Therefore, in this case, as illustrated in FIG. 17, the bearings 47*a* on the left side having a small volume may be arranged on the same side as the side (the one side A) where the temperature of the fixing device 9 becomes high. As a result, since the side where the temperature of the developing device 4 becomes high and the side where the temperature of the fixing device 9 becomes high are the same side, it is possible to effectively cool the portions of the fixing device 9 and the developing device 4 where the temperatures become high using one airflow path and one airflow generation device as described above.

In the example illustrated in FIG. 17, two types of bearings 47*a* and 47*b* having different volumes are used, but three or more types of bearings may be used. In this case, among the bearings, the bearings having the smallest volume may be disposed on the same side as the side (the one side A) where the temperature of the fixing device 9 becomes high.

Figure 18:
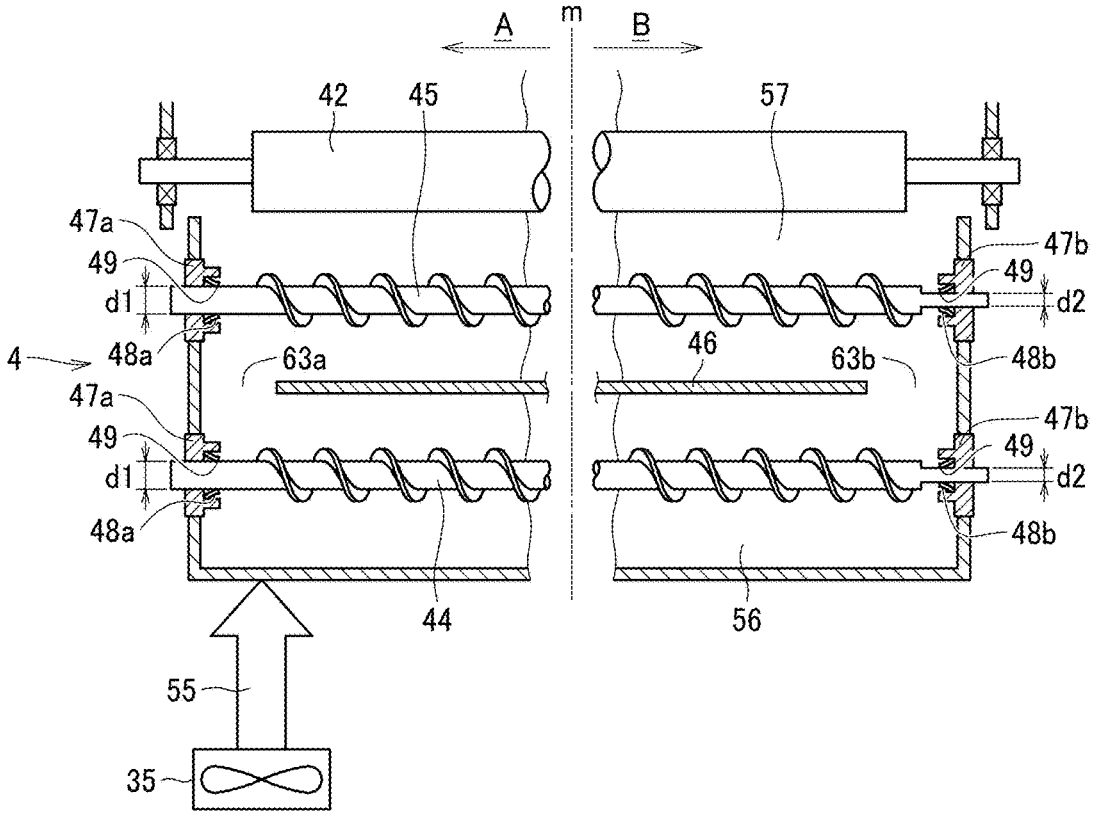
FIG. 18 is a diagram illustrating an example in which diameters of shaft portions at both ends of the conveyance screw are different.

Subsequently, FIG. 18 illustrates an example in which diameters d1 and d2 of the shaft portions at both ends of the conveyance screws 44 and 45 are different.

In a developing device, the diameters of the shaft portions on both end portions of the conveyance screws may be made different for the convenience of component layout or for the purpose of reducing frictional heat in the sliding portions of the seal members. In this case, the larger the diameters of the shaft portions, the longer the circumferential lengths of the shaft portions, and thus the sliding speed of the sliding portions 49 of the seal members 48*a* and 48*b* becomes faster. In addition, when the sliding speed becomes faster, frictional heat generated in the sliding portions 49 increases, so that the temperature tends to rise. In addition, as the shaft diameters on one end portion of the conveyance screws are made larger than the shaft diameters on the other end portion, the volumes of the bearings supporting the shaft portions on one end portion having a large diameter may be reduced. In this case, since the temperatures of the bearings having a small volume are likely to rise, the temperatures of the conveyance screws on one end portion are more likely to rise. In the example illustrated in FIG. 18, among the shaft portions on both end portions of the conveyance screws 44 and 45, the diameters d1 of the shaft portions on the left side in the drawing are larger than the diameters d2 of the shaft portions on the right side in the drawing. The bearings 47*a* on the left side in the drawing that support the shaft portions having a large diameter have smaller volumes than the bearings 47*b* on the right side in the drawing. Therefore, in the example illustrated in FIG. 18, large amounts of frictional heat are generated in the sliding portions 49 on the left side of the developing device 4, where the temperatures are likely to rise.

Therefore, in this case, as illustrated in FIG. 18, the sliding portions 49 on the left side (sliding portions that slide with respect to the shaft portions having the large diameter d1) and the bearings 47*a* on the left side (bearings having small volumes) may be arranged on the same side as the side where the temperature of the fixing device 9 becomes high (the one side A). As a result, since the side where the temperature of the developing device 4 becomes high and the side where the temperature of the fixing device 9 becomes high are the same side, it is possible to effectively cool the portions of the fixing device 9 and the developing device 4 where the temperatures become high using one airflow path and one airflow generation device as described above.

In the example illustrated in FIG. 18, the conveyance screws 44 and 45 have the shaft portions having two types of diameters, and the bearings 47*a* and 47*b* have two types of volumes. However, the diameters of the shaft portions and the volumes of the bearings may be of three or more types. In this case, among the shaft portions and the bearings, the sliding portions 49 sliding relative to the shaft portions having the largest diameters and the bearings having the smallest volumes may be disposed on the same side as the side where the temperature of the fixing device 9 becomes high (the one side A). In addition, when only one sliding portion 49 is provided, it can be said that the one sliding portion 49 is a sliding portion that slides relative to the shaft portion having the largest diameter. Therefore, in that case, the one sliding portion 49 may be disposed on the same side as the side where the temperature of the fixing device 9 becomes high (the one side A).

Figure 19:
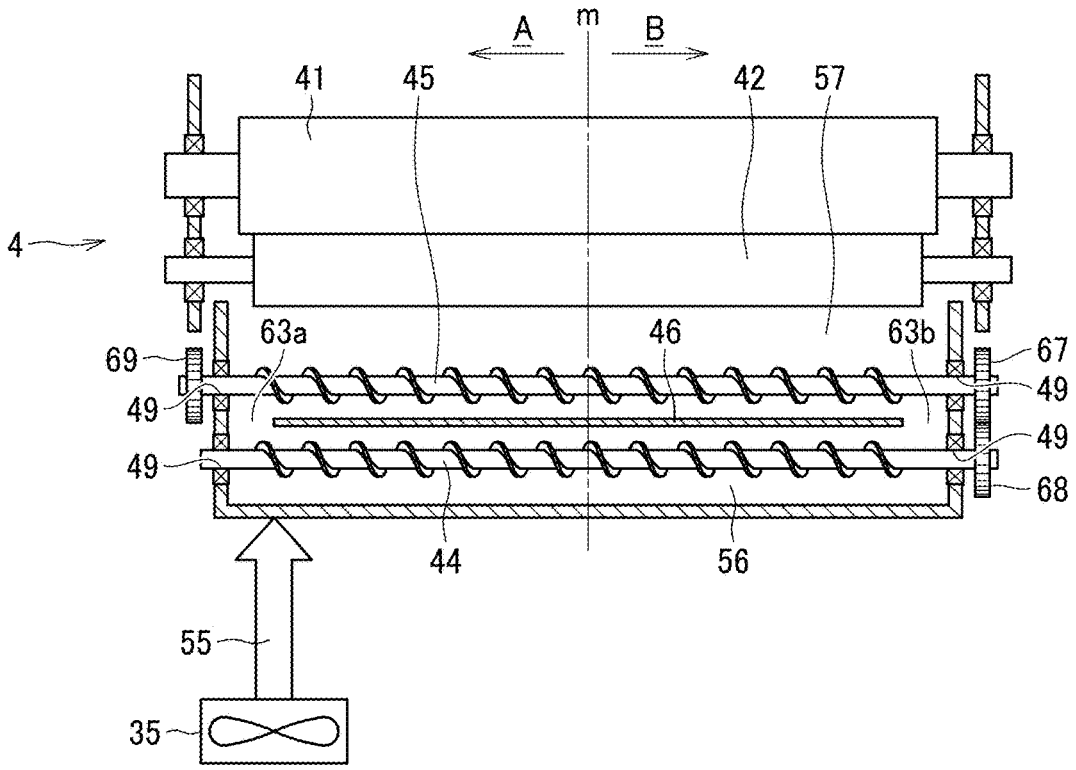
FIG. 19 is a diagram illustrating a drive transmission structure of the conveyance screws.

FIG. 19 is a diagram illustrating a drive transmission structure of the conveyance screws 44 and 45.

As illustrated in FIG. 19, in this example, an input gear 69 as a driving force input portion is provided at one axial end of the conveyance screw 45 on the upper side of the drawing. Further, on the side axially opposite to the input gear 69, transmission gears 67 and 68 as driving force transmission portions are provided at the ends of the conveyance screws 44 and 45 so as to mesh with each other.

In the example illustrated in FIG. 19, when the developing device 4 is mounted in the image forming apparatus, the input gear 69 is connected to a driving gear provided in the main body of the image forming apparatus. In this state, when the driving source provided in the main body of the image forming apparatus is driven, driving force is input to one conveyance screw 45 via the input gear 69 so that the conveyance screw 45 is rotationally driven. Then, the driving force is transmitted from one conveyance screw 45 to the other conveyance screw 44 via the transmission gears 67 and 68, so that the other conveyance screw 44 is also rotationally driven in conjunction with the one conveyance screw 45.

As described above, in the configuration in which the input gear 69 is provided on one end of the conveyance screw 45, generally, a load applied to the sliding portions 49 on the input gear 69 side or the sliding portion 49 closest to the input gear 69 becomes large in particular. For this reason, frictional heat generated in the sliding portions 49 on the input gear 69 side increases, and the temperature is likely to rise on the input gear 69 side.

Therefore, in this case, as illustrated in FIG. 19, the input gear 69 and the sliding portion 49 closest thereto may be arranged on the same side as the side where the temperature of the fixing device 9 becomes high (the one side A). As a result, since the side where the temperature of the developing device 4 becomes high and the side where the temperature of the fixing device 9 becomes high are the same side, it is possible to effectively cool the portions of the fixing device 9 and the developing device 4 where the temperatures become high using one airflow path and one airflow generation device as described above.

In the example illustrated in FIG. 19, focusing on the conveyance screw 44 on the lower side of the drawing, it can be said that the right side of the drawing, which is the side on which the transmission gear 68 is provided, is the driving force input side of the conveyance screw 44. However, the driving force input portion in the present disclosure is not a portion to which the driving force is transmitted (input) from one conveyance screw to the other conveyance screw, but refers to a portion on the most upstream side in a series of transmission paths to which the driving force is transmitted via a plurality of conveyance screws.

Figure 20:
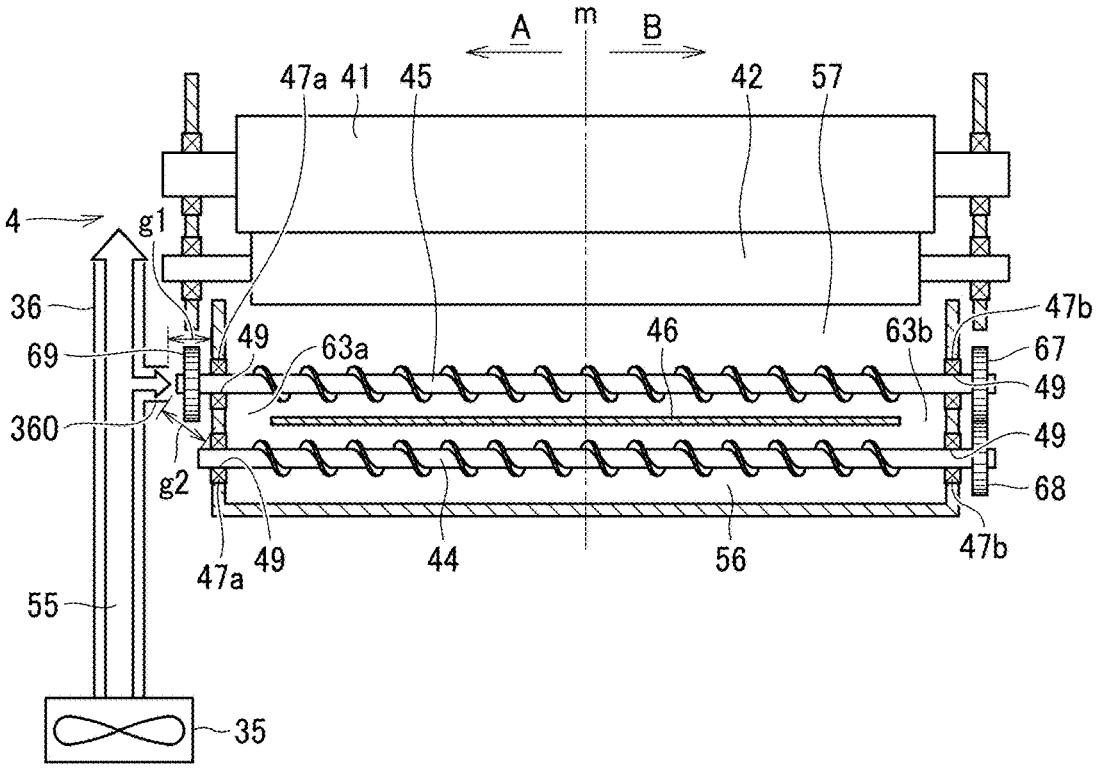
FIG. 20 is a diagram illustrating an example in which a flow path forming member that blows out an airflow toward a bearing is provided.

In addition, as in the example illustrated in FIG. 20, the flow path forming member 36 having the opening 360 through which an airflow is blown out may be provided on the input gear 69 side (the one side A). In this case, out of the two bearings 47*a* on the input gear 69 side, in particular, the bearing 47*a* (the upper bearing 47*a* in FIG. 21) supporting the conveyance screw 45 provided with the input gear 69 tends to easily rise in temperature. Therefore, a distance g1 between the bearing 47*a* supporting the conveyance screw 45 provided with the input gear 69 and the opening 360 is preferably shorter than a distance g2 between the other bearing 47*a* (the lower bearing 47*a* in FIG. 20) and the opening 360. That is, among the distances between the plurality of bearings and the plurality of openings, the distance between the bearing having the highest temperature and the opening is preferably shorter than the distances between the other bearings and the (same) opening. This makes it possible to effectively cool the bearing having the highest temperature.

Figure 21:
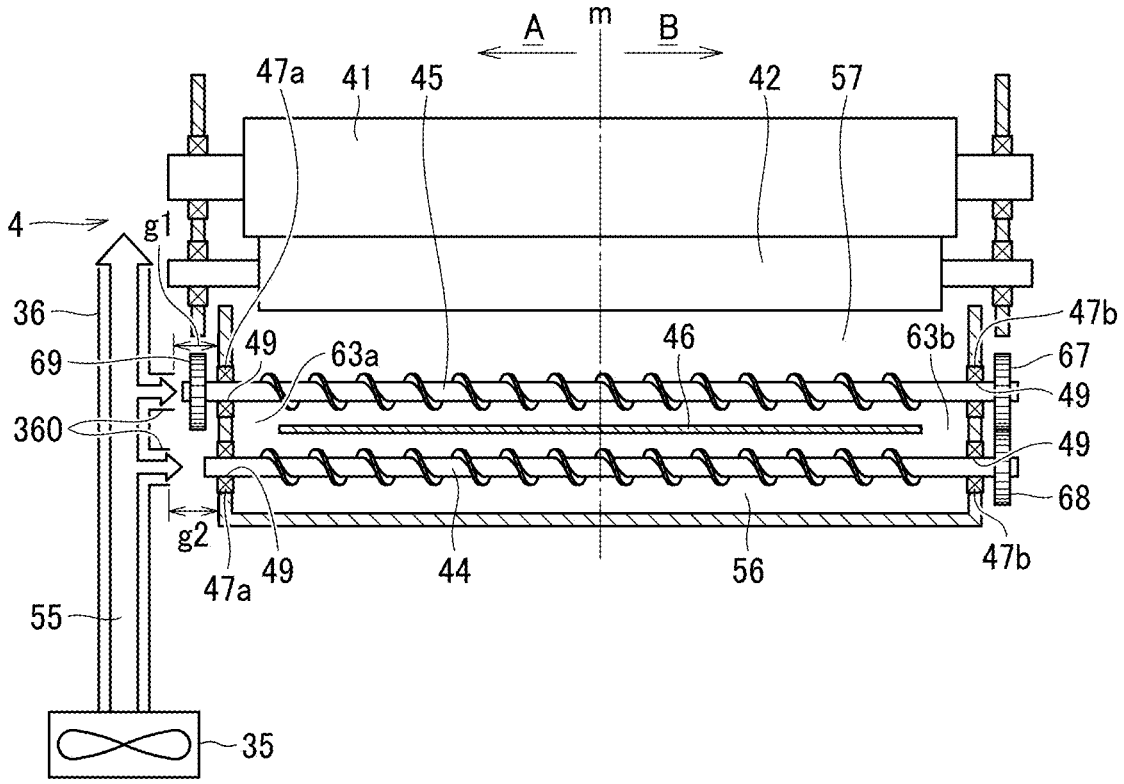
FIG. 21 is a diagram illustrating an example in which a flow path forming member having a plurality of openings through which airflows are individually blown out toward a plurality of bearings is provided.

In addition, as in the example illustrated in FIG. 21, the flow path forming member 36 may have a plurality of openings 360 through which airflows are individually blown out toward the plurality of bearings 47*a* on the input gear 69 side (the one side A). Also in this case, a distance g1 between the bearing 47*a* having the highest temperature (the bearing 47*a* on the upper side of FIG. 21) and the opening 360 facing the bearing 47*a* is preferably shorter than a distance g2 between the other bearing 47*a* (the bearing 47*a* on the lower side of FIG. 21) and the opening 360 facing the bearing.

Figure 22:
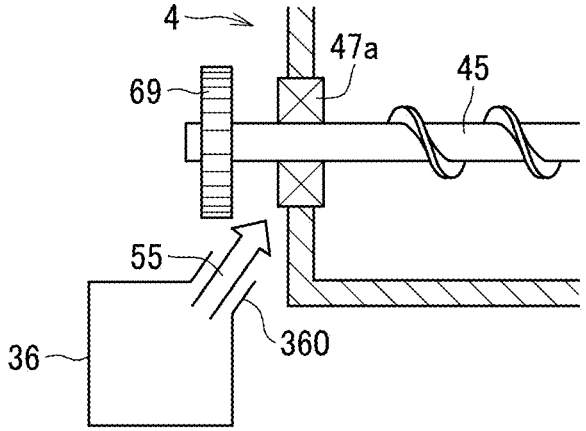
FIG. 22 is a diagram illustrating an example in which an airflow is blown onto the beating from below in the direction of gravity.

However, if it is attempted to blow the airflow to the bearing 47*a* from the axial direction, the input gear 69 may interfere so that the airflow is hardly effectively blown. Therefore, as illustrated in FIG. 22, the airflow 55 may be blown from a direction inclined with respect to the axial direction of the bearing 47*a* toward the axial direction of the bearing 47*a*. In the example illustrated in FIG. 22, the opening 360 of the flow path forming member 36 is disposed below the bearing 47*a* seen in the direction of gravity, and blows the airflow from below to obliquely above to the bearing 47*a* seen in the direction of gravity. As a result, the airflow 55 is less likely to be obstructed by the input gear 69, and the airflow 55 can be effectively blown against the bearing 47*a*. Note that the direction in which the airflow is blown may be a direction from the upper side to the obliquely lower side seen in the direction of gravity as long as the direction is inclined with respect to the axial direction of the bearing, or may be other directions.

Figure 23:
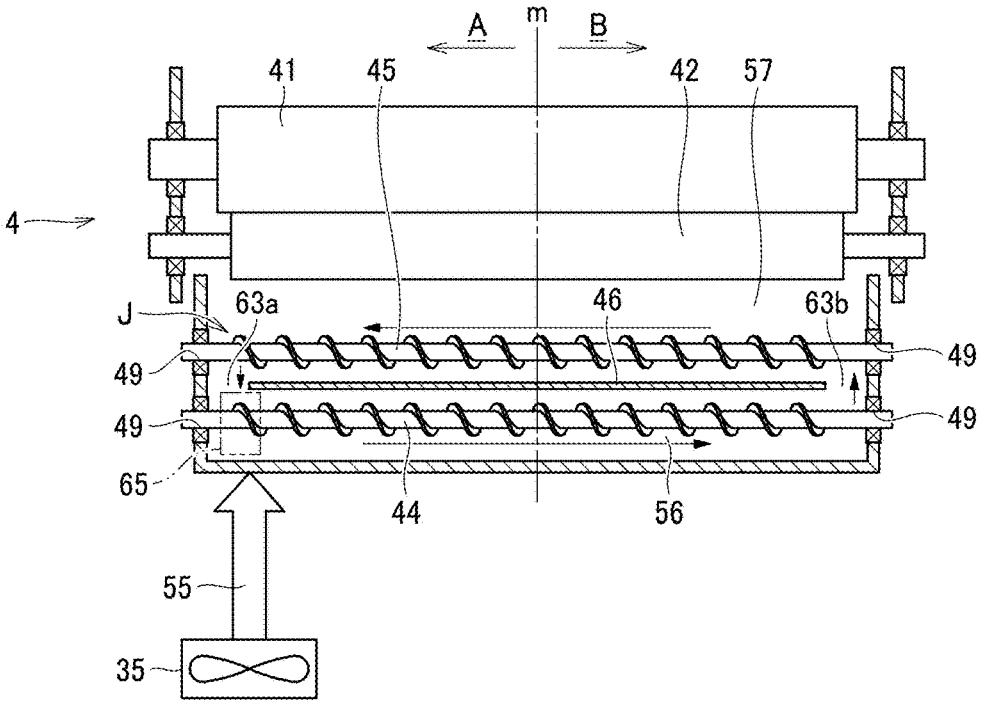
FIG. 23 is a diagram illustrating a circulation path of a developer in the developing device.

FIG. 23 is a diagram illustrating a circulation path of the developer in the developing device 4.

As illustrated in FIG. 23, in this example, the replenishment port 65 for replenishing the developer is disposed in the first storage space 56 on the lower left side of the drawing. Therefore, in this example, the developer replenished from the replenishment port 65 is first conveyed to the right side of the drawing by the conveyance screw 45 arranged in the first storage space 56. Then, when the developer is conveyed to the right end of the first storage space 56 in the drawing, the developer moves to the second storage space 57 on the upper side of the drawing via one through hole 63*b* provided in the partition wall 46. The developer moved into the second storage space 57 is conveyed to the left side of the drawing by the conveyance screw 44 disposed in the second storage space 57. Then, when the developer is conveyed to the left end of the second storage space 57 in the drawing, the developer moves to the first storage space 56 again through the other through hole 63*a* provided in the partition wall 46. Thereafter, a lubricant is similarly conveyed to circulate in the developing device 4.

When the developer circulates, the developer is pushed and moved by the conveyance screws 44 and 45, and thus, the developer is brought under a pressure associated with conveyance. In particular, the pressure exerted on the developer increases at the most downstream position of the developer conveyance path where the developer is conveyed by the conveyance screws 44 and 45 from the position (the replenishment port 65) where the developer is supplied into the developing device 4. That is, in the example illustrated in FIG. 23, since the position at the left end of the second storage space 57 in the drawing is a most downstream position J of the developer conveyance path, the pressure exerted on the developer at this position J is particularly large. In addition, the pressure exerted on the developer also acts on the seal members 48*a* and 48*b* provided in the conveyance screws 44 and 45. Therefore, a large pressure acts on the seal member 48*a* disposed at or near the most downstream position J, and particularly large frictional heat is generated in the sliding portion 49 of the seal member 48*a*.

Figure 24:
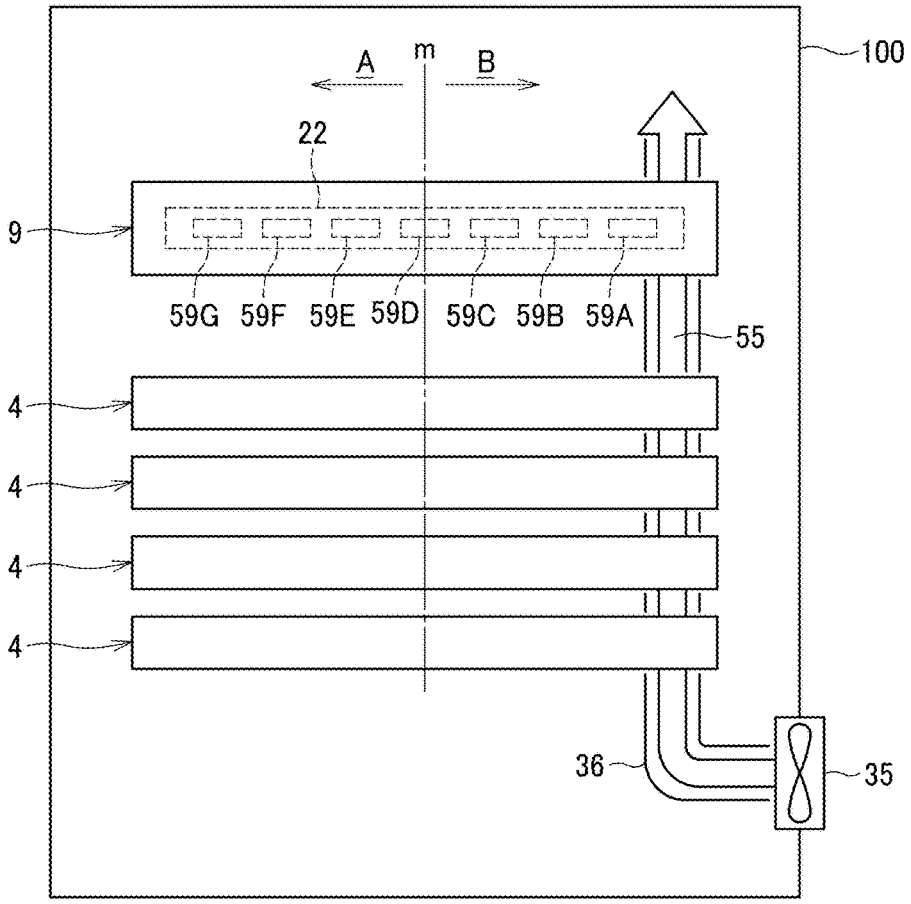
FIG. 24 is a diagram illustrating an example in which the present disclosure is applied to an image forming apparatus dedicated to A4 paper sheets.

Therefore, in the example illustrated in FIG. 24, the most downstream position J of the developer conveyance path and the sliding portion 49 closest to the most downstream position J are arranged on the same side as the side of the fixing device 9 where the temperature becomes high (the one side A). As a result, since the side where the temperature of the developing device 4 becomes high and the side where the temperature of the fixing device 9 becomes high are the same side, it is possible to effectively cool the portions of the fixing device 9 and the developing device 4 where the temperatures become high using one airflow path and one airflow generation device as described above.

Although the specific example of the portions where the temperature tends to be high in the developing device has been described above, the sliding portions where the temperature tends to be high are not limited to the sliding portions of the seal members with respect to the conveyance screws which are rotating members. The sliding portions may be, for example, sliding portions that slide relative to another rotating member such as a developing roller or a supply roller. In addition, the number of sliding portions is not limited to two or more, and may be only one.

In the above example, as one embodiment of the present disclosure, the case where the airflow is generated on the side where the temperature becomes high (the one side A) when all the resistive heat generators 59A to 59G generate heat (in the case of the example illustrated in FIG. 11) has been described as an example. However, the present disclosure is not limited to this embodiment, and the side where the temperature becomes high may be cooled in a case where some of the resistive heat generators 59B to 59F generate heat and unintended shunt current occurs (in the case of the example illustrated in FIG. 12). That is, in a case where the side where the temperature becomes high changes from one side to the other side depending on the usage mode or the like, the airflow may be selectively or additionally generated on the side where the temperature becomes high (the other side) at that time.

In addition, unintended shunt current can occur if the heater 22 as illustrated in FIG. 12 has a first conductive portion K1 extending from the first electrode portion 61A, a second conductive portion K2 connected to the second electrode portion 61B, and a third conductive portion (branch path) K3 branching from the second conductive portion K2. That is, in the example illustrated in FIG. 12, the first conductive portion K1 corresponds to the first power supply line 62 that connects the first electrode portion 61A and the resistive heat generators 59A to 59G (the first heat generation portion 60A) other than the two at both ends. In addition, the second conductive portion K2 is a portion of the second power supply line 62B that extends from the resistive heat generators 59B to 59F other than the two at both ends toward a first direction S1 (the right direction of FIG. 12) along the longitudinal direction of the heater 22 and is connected to the second electrode portion 61B. The third conductive portion K3 includes a portion extending from the branch portion X of the second power supply line 62B toward a second direction S2 opposite to the first direction S1, the third power supply line 62C, the third electrode portion 61C, the fourth power supply line 62D, and the resistive heat generators 59A and 59G (the second heating portions 60B) at the both ends. That is, the third conductive portion K3 is a conductive path connected to the second conductive portion K2 or the second electrode portion 61B via the resistive heat generators 59A and 59G (the second heat generation portion 60B) at the both ends and the third electrode portion 61C, without passing through the first conductive portion K1.

In the above example, the present disclosure has been described by taking a mode as an example in which the heater is selectively used depending on a case where paper sheets of small size such as A4 are conveyed and a case where paper sheets of large size such as A3 are conveyed. However, the present disclosure is not limited to such a type of image forming apparatus in which a heater is selectively used depending on paper sheet size, but is also applicable to an image forming apparatus dedicated to A4 paper sheets or A3 paper sheets equipped with a heater of the same configuration for commonality of components.

In this case, in the image forming apparatus dedicated to A4 paper sheets, basically, as in the example illustrated in FIG. 12, only the resistive heat generators 59B to 59F (the first heating portion 60A) other than the two at both ends are caused to generate heat. In such a usage mode, the temperature on the other side B of the heater 22 (on the second direction S2 side with respect to the longitudinal center m) becomes higher than the temperature on the one side A (on the first direction S1 side with respect to the longitudinal center m). Therefore, in this case, as illustrated in FIG. 24, both the side where the temperature of the fixing device 9 becomes high and the side where the temperatures of the developing devices 4 become high may be arranged on the other side B, and the airflow 55 may be generated on the other side B.

On the other hand, in the image forming apparatus dedicated to A3 paper sheets, all the resistive heat generators 59A to 59G are caused to generate heat, so that the temperature of the heater 22 becomes high on the one side A (on the first direction S1 side with respect to the longitudinal center m) as illustrated in FIG. 11, contrary to the image forming apparatus dedicated to A4 paper sheets. Therefore, in this case, similarly to the example illustrated in FIG. 13 described above, both the side where the temperature of the fixing device 9 becomes high and the side where the temperatures of the developing devices 4 become high may be arranged on the one side A, and the airflow 55 may be generated on the one side A.

As described above, according to the present disclosure, it is possible to effectively cool respective high temperature portions of the fixing device and the developing devices without individually providing dedicated airflow paths in the fixing device and the developing devices, and it is possible to realize downsizing and cost reduction of the image forming apparatus. In addition, according to the present disclosure, it is possible to restrain a disadvantage such as deterioration in image quality due to variations in temperature distribution in the longitudinal direction of the heater. For this reason, it is possible to actively use even a small-sized heater in which variations in the temperature distribution are likely to be remarkable or a heater that generates an increased amount of heat in response to speed enhancement.

In order to reduce the size of the heater in the lateral direction thereof, the following three methods can be mentioned.

The first method is a method by which to reduce the size of the heat generation portions (resistive heat generators) in the lateral direction. However, in this method, as a result of the heat generation portions being reduced in the lateral direction, the width of the heating region where the fixing belt is heated is reduced. For this reason, in a case where the amount of heat applied to the fixing belt is to be secured to the same extent as before, there arises a problem that the heat-up peak value increases. When the heat-up peak value increases, the temperature of the overheating detection device such as a thermostat or a fuse provided on the back surface of the heater may exceed the heat-resistant temperature, or the overheating detection device may malfunction. In addition, when the heat-up peak value increases, the efficiency of heat transfer from the heater to the fixing belt decreases, which is not preferable from the viewpoint of energy efficiency. As described above, there are circumstances where it is difficult to adopt the method of reducing the size of the heat generation portions in the lateral direction.

The second method is a method by which to reduce in the lateral direction the size of portions of the heater where none of the heat generation portions, the electrode portions, and the power supply lines is provided. However, in this method, spacing between the heat generation portions and the power supply lines or spacing between the electrode portions and the power supply lines become small, so that insulation may not be secured. In view of the current structure of the heater, it is difficult to further reduce the spacing between the heat generation portions and the power supply lines or between the electrode portions and the power supply lines.

The third method is a method by which to reduce the size of the power supply lines in the lateral direction. This method is more feasible than the above two methods. However, if the power supply line is reduced in the lateral direction, the resistance values of the power supply lines increase, so that unintended shunt current may occur on the conductive path of the heater, and the temperature distribution may vary significantly. In particular, when the resistance values of the heat generation portions are reduced in order to increase the amounts of heat generation by the heat generation portions in correspondence with the increasing speed of the image forming apparatus, the resistance values of the power supply lines and the resistance values of the heat generation portions relatively approach each other, so that unintended shunt current is likely to occur. As a method of avoiding such unintended shunt current, it is conceivable to make the power supply lines larger in the thickness direction (the direction intersecting the longitudinal direction and the lateral direction) in exchange for making the power supply lines smaller in the lateral direction, thereby to secure the cross-sectional areas of the power supply lines and restrain an increase in the resistance values of the power supply lines. However, in this case, it becomes difficult to perform screen printing of the power supply line, which requires changing the manner of forming the power supply lines. Therefore, it is difficult to adopt the solution of thickening the power supply lines. Therefore, in order to realize downsizing of the heater in the lateral direction, it is necessary to reduce the size of the power supply lines in the lateral direction in anticipation of an increase in the resistance values, and to take a separate measure against unintended shunt current and variations in heat generation distribution that may occur due to the reduced size of the power supply lines. Therefore, in the present disclosure, as described above, the airflow is generated on the side of the fixing device where the temperature becomes high, so that the variations in the temperature distribution can be effectively restrained.

Specifically, when the present disclosure is applied to an image forming apparatus including a small-sized heater as described below, a particularly large advantageous effect can be expected.

Table 1 below illustrates variations in heat generation distribution when the heater is downsized in the lateral direction. In the test for obtaining the results illustrated in Table 1, temperature differences were measured between the longitudinal center and ends of heat generation region of heaters with differences in the ratio (R/Q) of lateral direction dimension R of the resistive heat generators 59A to 59G to lateral direction dimension Q of the base 50 illustrated in FIG. 25. The surface temperatures of the heaters were measured using infrared thermography (FLIR T620) manufactured by FRIA Systems Incorporated. When the ratio (R/Q) of the lateral direction dimension of the resistive heat generators 59A to 59G to the lateral direction dimension of the base 50 is 80% or more, the ratio is too large and it is practically difficult to secure the installation space of the power supply line, so that the measurement is suspended.

TABLE 1

| Lateral dimension ratio (R/Q) | Temperature difference between center and ends |
|---|---|
| 20% or more to less than 25% | Less than 2° C. |
| 25% or more to less than 40% | 2° C. or more to less than 5° C. |
| 40% or more to less than 70% | 5° C. or more |
| 70% or more to less than 80% | 5° C. or more |
| 80% or more | — |

As illustrated in Table 1, as the lateral direction dimension ratio (R/Q) increases, the temperature difference between the longitudinal center and the ends of the heat generation region increases. For this reason, heaters with large lateral direction dimension ratios (R/Q), that is, heaters downsized in the lateral direction may have significant variations in temperature at both longitudinal ends. In particular, heaters with lateral direction dimension ratios (R/Q) of 25% or more or 40% or more have large temperature differences (5° C. or more) between the longitudinal center and ends of the heat generation region, and thus, these heaters may also have significant variations in temperature at both longitudinal ends. Therefore, the present disclosure can be expected to have a large advantageous effect particularly when applied to image forming apparatuses including heaters with lateral direction dimension ratios (R/Q) of 25% or more and less than 80% or 40% or more and less than 80%.

Figure 25:
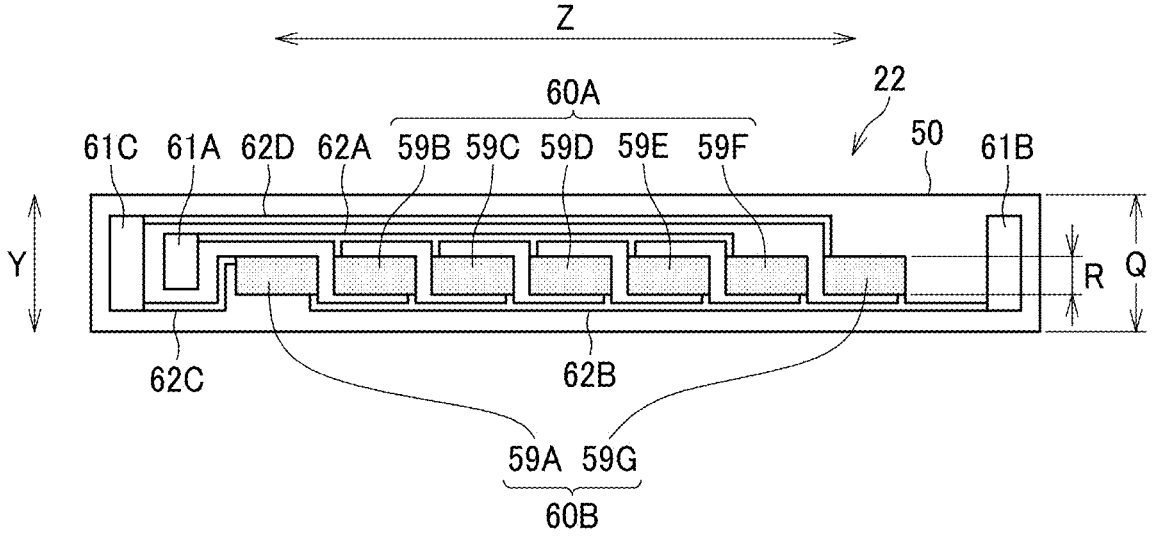
FIG. 25 is a plan view explaining a configuration of a miniaturized heater.
Figure 26:
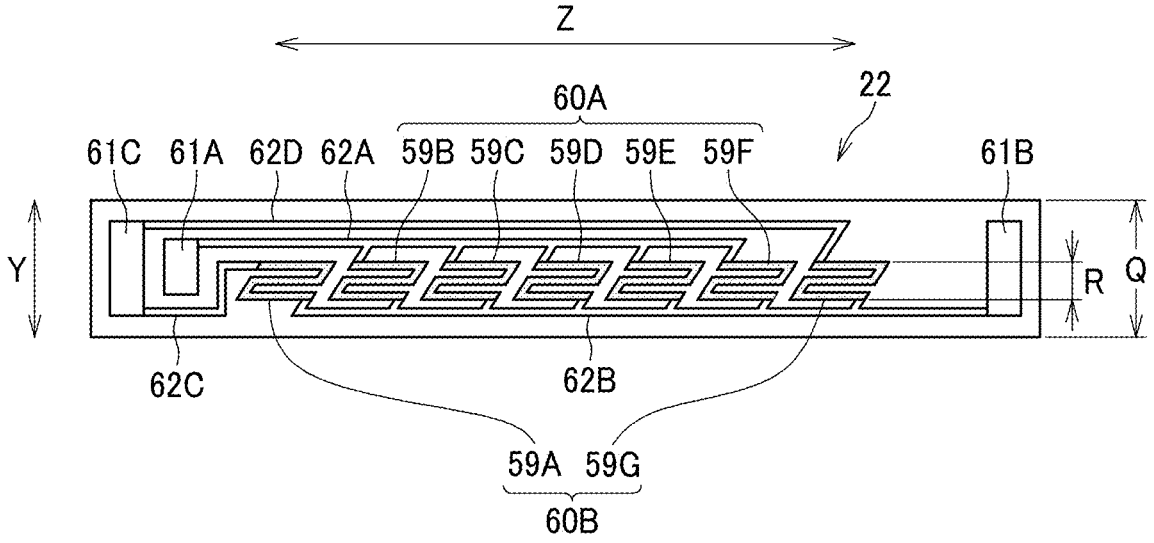
FIG. 26 is a plan view of another heater.

Further, the heater included in the fixing device according to the present disclosure is not limited to the heater 22 having the block-shaped (square) resistive heat generators 59A to 59G as illustrated in FIG. 25. For example, the heater may be a heater 22 having resistive heat generators 59A to 59G shaped such that straight lines are folded back as illustrated in FIG. 26. In the heater 22 illustrated in FIG. 26, the lateral direction dimension R of the resistive heat generators 59A to 59G means the lateral direction dimension of the entire resistive heat generators, not the thickness of one each linear portion of the resistive heat generators formed to be folded back. Further, the base 50 may have a shape in which the lateral direction dimension Q changes depending on the position seen in the longitudinal direction Z. In this case, however, the smallest lateral direction dimension of the base 50 within the longitudinal range (within the heat generation region) in which the resistive heat generators 59A to 59G are disposed is defined as the lateral direction dimension Q of the base 50.

Figure 27:
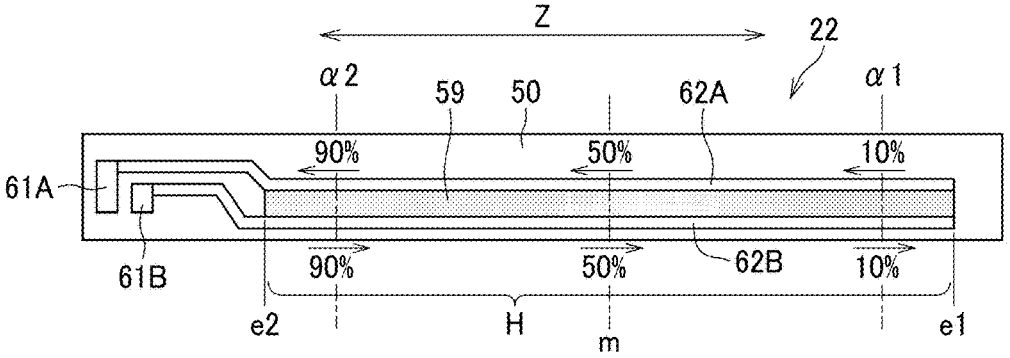
FIG. 27 is a plan view of still another heater.

Further, the heater may be a heater 22 as illustrated in FIG. 27. The heater 22 illustrated in FIG. 27 includes one resistive heat generator 59 extending in the longitudinal direction Z of the base 50 unlike the above-described heaters. The resistive heat generator 59 is connected to a first electrode portion 61A and a second electrode portion 61B via two power supply lines 62A and 62B. In the example illustrated in FIG. 27, the electrode portions 61A and 61B are disposed on the same end portion with respect to a longitudinal center m of a heat generation region H, and the power supply lines 62A and 62B extend without being folded back in the longitudinal direction Z.

Even in the heater 22 as illustrated in FIG. 27, when a potential difference is generated between the electrode portions 61A and 61B to cause the resistive heat generator 59 to generate heat, variations in temperature distribution occur. Specifically, in the example illustrated in FIG. 27, the currents flowing in the power supply lines 62A and 62B at the longitudinal center m of the heat generation region H and at arbitrary symmetrical positions $\alpha$1 and $\alpha$2 with respect to the longitudinal center m on both e1 and e2 sides of the heat generation region H are 50%, 10%, and 90%, respectively. In this case, the amounts of heat generated in the power supply lines 62A and 62B take values as illustrated in the table in FIG. 27. As in the above example, the amounts of heat are the squares (I) of the currents flowing through the power supply lines for convenience.

As illustrated in the table in FIG. 27, in this example, since the total amounts of heat generation of the power supply lines 62A and 62B become higher on the other side closer to the longitudinal end e2 (the left side of FIG. 27) than on the one side closer to the longitudinal end e1 (the right side of FIG. 27), variations in temperature distribution occur in the longitudinal direction. Therefore, the variations in the temperature distribution can be effectively reduced by applying the present disclosure to the fixing device including such a heater. This makes it possible to improve a problem such as deterioration in image quality due to variations in temperature distribution of the heater.

In addition, in order to reduce variations in temperature distribution in the longitudinal direction, a resistive heat generator with a positive temperature coefficient (PTC) characteristic may be used. Here, the PTC characteristic is a characteristic of the resistance value increasing as the temperature increases (a characteristic of the heater output decreasing under a constant voltage). When the resistive heat generator with the PTC characteristic is used, the temperature of the heater rises at a high speed due to a high output at a low temperature, and the overheating of the heater can be restrained by a low output at a high temperature. For example, when the temperature coefficient of resistance (TCR) of the PTC characteristic is about 300 to 4000 ppm/° C., the resistance value necessary for the heater can be ensured at low cost. More preferably, the TCR is 500 to 2000 ppm/° C.

The TCR can be calculated using the following formula (2). In the formula (2), T0 is a reference temperature, T1 is an arbitrary temperature, R0 is a resistance value at the reference temperature T0, and R1 is a resistance value at the arbitrary temperature T1. For example, in the heater 22 illustrated in FIG. 10, when the resistance value between the first electrode portion 61A and the second electrode portion 61B is 10Ω (the resistance value R0) at 25° C. (the reference temperature T0) and 12Ω (the resistance value R1) at 125° C. (the arbitrary temperature T1), the temperature coefficient of resistance is 2000 ppm/° C. according to the formula (2).

[Mathematical formula 2]

$$\text{Temperature coefficient of resistance (TCR)}=(R1-R0)/R0/(T1-T0)\times 10^6 \quad (2)$$

Figure 28:
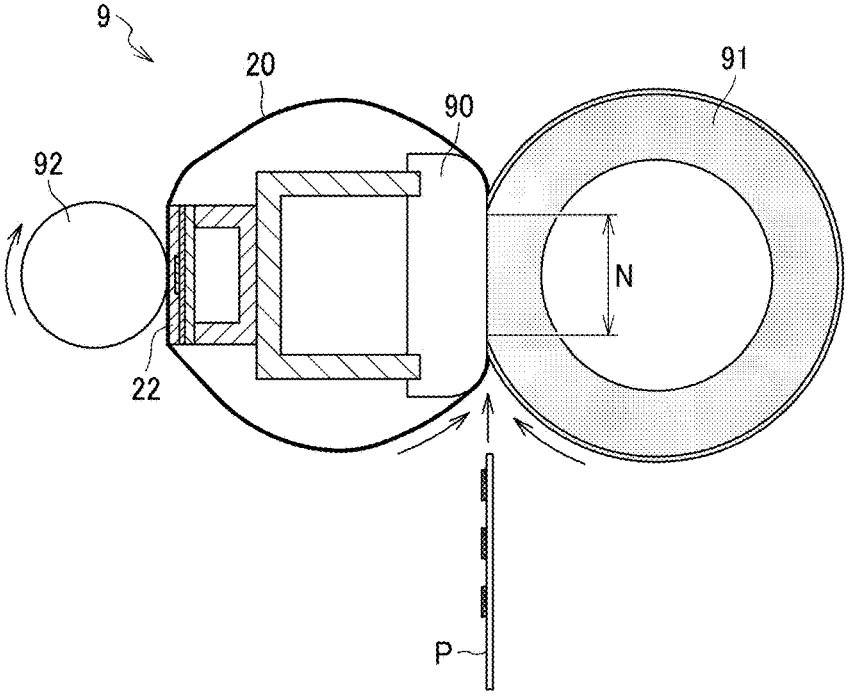
FIG. 28 is a diagram illustrating a configuration of another fixing device.
Figure 29:
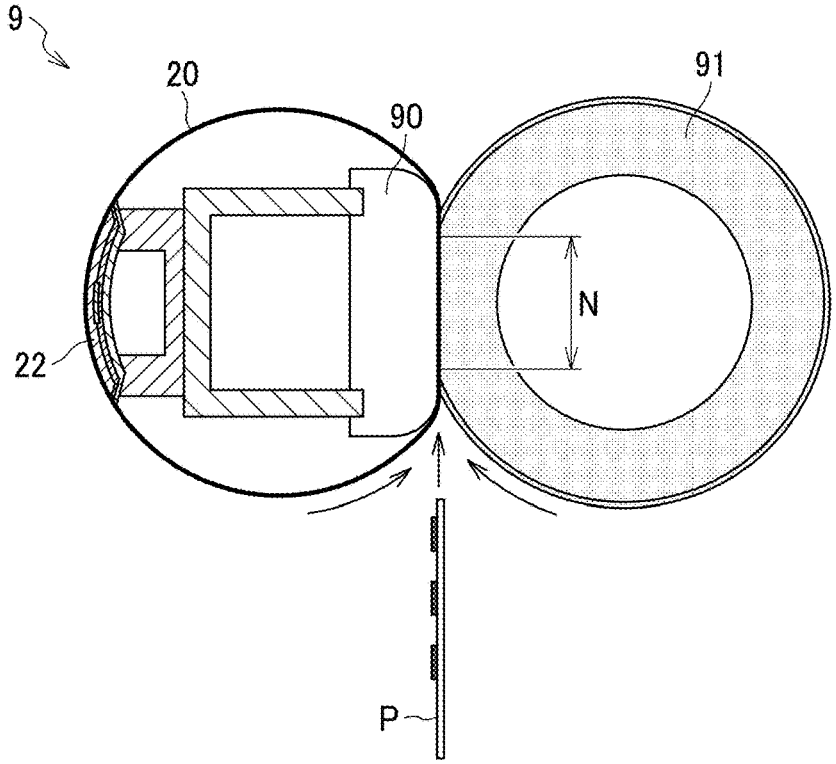
FIG. 29 is a diagram illustrating a configuration of another fixing device.
Figure 30:
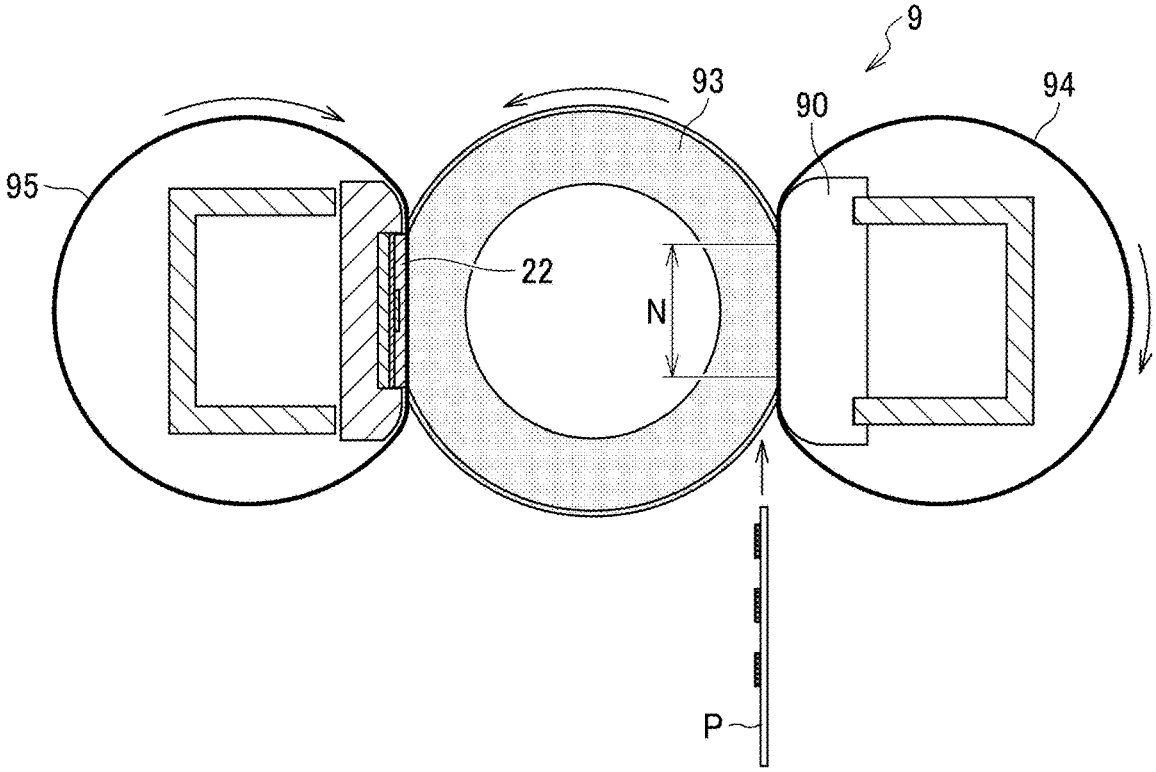
FIG. 30 is a diagram illustrating a configuration of still another fixing device.

Furthermore, the fixing device cooled by the cooling device according to the present disclosure is not limited to the fixing device as illustrated in FIG. 2, and may be any one of fixing devices as illustrated in FIGS. 28 to 30.

In the fixing device 9 illustrated in FIG. 28, unlike the fixing device illustrated in FIG. 2, a nip portion N for letting pass a paper sheet P and a portion of a fixing belt 20 heated by a heater 22 are set at different positions. Specifically, the heater 22 and a nip formation member 90 are disposed on sides opposite to each other by 180° seen in the rotation direction of the fixing belt 20. Then, pressure rollers 91 and 92 are pressed against the heater 22 and the nip formation member 90 with the fixing belt 20 in between.

The fixing device 9 illustrated in FIG. 29 is an example in which, in the fixing device illustrated in FIG. 28, the pressure roller 92 on the heater 22 side is omitted and the heater 22 is formed in an arc shape in accordance with the curvature of the fixing belt 20. Other components are the same as those illustrated in FIG. 28. In this case, since the heater 22 is formed in an arc shape, a contact length between the fixing belt 20 and the heater 22 along the belt rotation direction is secured, so that the fixing belt 20 can be efficiently heated.

The fixing device 9 illustrated in FIG. 30 is an example in which belts 94 and 95 are arranged on both sides of a roller 93, respectively. In this case, similarly to the examples illustrated in FIGS. 28 and 29, a nip portion N through which the paper sheet P passes and a portion of the belt heated by the heater 22 are set at different positions. That is, the nip formation member 90 is in contact with the roller 93 with one belt 94 in between on the right side of the drawing, and the heater 22 is in contact with the roller 93 with the other belt 95 in between on the opposite side.

Also in the image forming apparatus including the fixing device of any one of FIGS. 28 to 30 as described above, applying the present disclosure makes it possible to effectively cool the fixing device and the developing devices while reducing the size and cost of the image forming apparatus.

In addition, the fixing device according to the present disclosure is not limited to a free belt-type fixing device that holds the fixing belt 20 by a pair of belt holding members (for example, a pair of supporting members 32 illustrated in FIG. 4). For example, the present disclosure is also applicable to a fixing device that stretches and holds a fixing belt using a plurality of rollers or the like.

In each of the above-described embodiments, as an example, the present disclosure is applied to an electrophotographic image forming apparatus including a fixing device that is an example of a heating device. However, the image forming apparatus according to the present disclosure is not limited to an electrophotographic apparatus. For example, the present disclosure is also applicable to an inkjet-type image forming apparatus including a drying device (heating device) that heats a paper sheet to dry ink (liquid) on the paper sheet.

Numerous additional modifications and variations are possible in light of the above teachings. It is therefore to be understood that, within the scope of the above teachings, the present disclosure may be practiced otherwise than as specifically described herein. With some embodiments having thus been described, it will be obvious that the same may be varied in many ways. Such variations are not to be regarded as a departure from the scope of the present disclosure and appended claims, and all such modifications are intended to be included within the scope of the present disclosure and appended claims.

The invention claimed is:

1. An image forming apparatus comprising:

a heating device including a heater;

a developing device; and an airflow generation device, wherein the heater includes:

a base;

a heat generator;

an electrode portion; and a plurality of conductive portions connecting the heat generator and the electrode portion, wherein the plurality of conductive portions are disposed on one side and another side of the heater, the one side being opposite to said another side with respect to a center in a longitudinal direction of the heater in a heat generation region of the heater, wherein the plurality of conductive portions are spaced apart in a lateral direction intersecting the longitudinal direction along a surface of the heater on which the heat generator is disposed, wherein a maximum total value among total values of squares of current flowing in the plurality of conductive portions at arbitrary longitudinal positions on the one side in the heat generation region is larger than a maximum total value among total values of squares of current flowing in the plurality of conductive portions at arbitrary longitudinal positions on said another side in the heat generation region, wherein the developing device includes:

a rotating member; and a plurality of sliding portions configured to slide relative to the rotating member, wherein a sliding portion having a highest temperature in operation among the plurality of sliding portions is disposed on one side of the developing device that is same as the one side of the heater in the longitudinal direction of the heater, and wherein the airflow generation device is configured to generate an airflow toward the one side of the developing device.

2. The image forming apparatus according to claim 1, wherein the developing device includes a drive force input portion configured to input a drive force to the rotating member on the one side of the developing device.

3. The image forming apparatus according to claim 1,
wherein the plurality of sliding portions are configured to slide relative to a plurality of shaft portions of the rotating member, and
wherein a sliding portion of the plurality of sliding portions configured to slide relative to a shaft portion having a largest diameter of the plurality of shaft portions is disposed on the one side of the developing device.

4. The image forming apparatus according to claim 1,
wherein the developing device includes a plurality of bearings rotatably supporting the rotating member on the one side and another side opposite the one side in the longitudinal direction, and
wherein a bearing having a smallest volume among the plurality of bearings is disposed on the one side.

5. The image forming apparatus according to claim 4,
wherein the bearing having the smallest volume among the plurality of bearings supports a portion of the rotating member having a larger shaft diameter than any other bearing of the plurality of bearings.

6. The image forming apparatus according to claim 1,
wherein the developing device is disposed upstream from the heating device in a direction in which the airflow flows.

7. The image forming apparatus according to claim 1, further comprising a flow path forming member configured to guide the airflow,
wherein the flow path forming member has a plurality of openings through which the airflow is blown out to the heating device and the developing device.

8. The image forming apparatus according to claim 7,
wherein the developing device includes a plurality of bearings, and
wherein an opening through which the airflow is blown out to the developing device among the plurality of openings is disposed such that a distance between a bearing having a highest temperature in operation among the plurality of bearings and the opening is shorter than a distance between any other bearing among the plurality of bearings and the opening.

9. The image forming apparatus according to claim 8,
wherein the opening through which the airflow is blown out to the developing device blows out the airflow from a direction inclined with respect to an axial direction of the bearing having the highest temperature in operation among the plurality of bearings toward the axial direction of the bearing having the highest temperature.

10. The image forming apparatus according to claim 1,
wherein the developing device includes a conveyance member configured to convey a developer in the developing device, and
wherein a most downstream position of a developer conveyance path in which the developer is conveyed by the conveyance member from a position where the developer is supplied into the developing device is disposed on the one side of the developing device.

11. The image forming apparatus according to claim 1,
wherein in the lateral direction intersecting the longitudinal direction along the surface of the heater on which the heat generator is disposed, a ratio of a dimension of the heat generator to a dimension of the heater is 25% or more to less than 80%.

12. The image forming apparatus according to claim 1,
wherein in the lateral direction intersecting the longitudinal direction along the surface of the heater on which the heat generator is disposed, a ratio of a dimension of the heat generator to a dimension of the heater is 40% or more to less than 80%.

13. An image forming apparatus comprising:
a heating device including a heater;
a developing device; and
an airflow generation device,
wherein the heater includes:
a heat generation portion having at least one heat generator;
a first electrode portion;
a second electrode portion;
a first conductive portion connecting the heat generation portion and the first electrode portion;
a second conductive portion extending from the heat generation portion toward first end of the heater in a longitudinal direction of the heater and being connected to the second electrode portion; and
a third conductive portion branching from the second conductive portion and extending toward a second end of the heater opposite to the first end in the longitudinal direction, the third conductive portion being connected to the second conductive portion or the second electrode portion not via the first conductive portion,
wherein the developing device includes:
a rotating member and a plurality of sliding portions configured to slide relative to the rotating member,
a sliding portion having a highest temperature in operation among the plurality of sliding portions is disposed on a same side in a longitudinal direction of the developing device as one side of the heater with respect to a center of the heater in the longitudinal direction, the one side of the heater having a higher temperature in operation than another side of the heater, said another side of the heater being opposite to the one side of the heater with respect to the center in the longitudinal direction in a heat generation region of the heater, and
wherein the airflow generation device is configured to generate an airflow toward the one side.

14. The image forming apparatus according to claim 13, further comprising:
another heat generation portion including at least one heat generator different from the at least one heat generator of the heat generation portion; and
a third electrode portion;
wherein the heat generation portion and said another heat generation portion are configured to generate heat when a potential difference is generated between the first electrode portion and the second electrode portion and a potential difference is generated between the second electrode portion and the third electrode portion.

15. An image forming apparatus comprising:
a heating device including a heater;
a developing device; and
an airflow generation device,
wherein the heater includes:
a first heat generation portion including at least one heat generator;
a second heat generation portion including at least one heat generator different from the heat generator included in the first heat generation portion;
a first electrode portion;
a second electrode portion;
a third electrode portion;

a first conductive portion connecting the first heat generation portion and the first electrode portion;

a second conductive portion extending from the first heat generation portion toward a first end of the heater in a longitudinal direction of the heater and being connected to the second electrode portion; and a third conductive portion branching from the second conductive portion and extending toward a second end of the heater opposite to the first end in the longitudinal direction, the third conductive portion being connected to the second conductive portion or the second electrode portion via the second heat generation portion and the third electrode portion and not via the first conductive portion, wherein the first heat generation portion is configured to generate heat when a potential difference is generated between the first electrode portion and the second electrode portion, wherein the developing device includes:

a rotating member; and a plurality of sliding portions configured to slide relative to the rotating member, wherein a sliding portion having a highest temperature in operation among the plurality of sliding portions is disposed on a same side in a longitudinal direction of the developing device as a side on which the second end of the heater is disposed with respect to a center in a heat generation area of the heater in the longitudinal direction of the heater, and wherein the airflow generation device is configured to generate an airflow toward the side on which the second end of the heater is disposed with respect to the center in the longitudinal direction of the heater.

16. An image forming apparatus comprising:

a heating device including a heater;

a developing device; and an airflow generation device, wherein the heater includes;

a base;

a heat generator;

an electrode portion; and a conductive portion connecting the heat generator and the electrode portion, wherein a portion having a highest temperature in operation in the developing device is disposed on a same side in a longitudinal direction of the developing device as one side of the heater with respect to a center of the heater in the longitudinal direction, the one side of the heater having a higher temperature in operation than another side of the heater, said another side of the heater being opposite to the one side of the heater with respect to the center in the longitudinal direction in a heat generation region of the heater, and wherein the airflow generation device is configured to generate an airflow toward the one side.

17. An image forming apparatus comprising:

a heating device including a heater;

a developing device; and an airflow generation device, wherein the heater includes:

a base;

a heat generator;

an electrode portion; and a conductive portion connecting the heat generator and the electrode portion, wherein the developing device includes:

a rotating member; and a plurality of sliding portions configured to slide relative to the rotating member, wherein a sliding portion having a highest sliding speed in operation among the plurality of sliding portions is disposed on a same side as one side of the heater with respect to a center of the heater in a longitudinal direction of the heater, the one side of the heater having a higher temperature in operation than another side of the heater, said another side of the heater being opposite to the one side of the heater with respect to the center in the longitudinal direction in a heat generation region of the heater, and wherein the airflow generation device is configured to generate an airflow toward the one side.

* * * * *